US012631078B1

(12) United States Patent
Moore

(10) Patent No.: US 12,631,078 B1
(45) Date of Patent: May 19, 2026

(54) POWER CHARGE ADAPTER

(71) Applicant: GEODYNAMICS, INC., Millsap, TX (US)

(72) Inventor: Michael Kyle Moore, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 19/196,036

(22) Filed: May 1, 2025

(51) Int. Cl.
*E21B 23/04* (2006.01)

(52) U.S. Cl.
CPC ..... *E21B 23/0414* (2020.05)

(58) Field of Classification Search
CPC ..... E21B 23/0414
See application file for complete search history.

(56) References Cited

U.S. PATENT DOCUMENTS

| | | | |
|---|---|---|---|
| 3,398,803 | A | 8/1968 | Leutwyler |
| 3,524,408 | A | 8/1970 | Pierson |
| 4,007,796 | A | 2/1977 | Boop |
| 4,063,334 | A | 12/1977 | Rohman |
| 4,220,808 | A | 9/1980 | Fujita |
| 4,234,768 | A | 11/1980 | Boop |
| 4,324,182 | A | 4/1982 | Kirby et al. |
| 4,768,127 | A | 8/1988 | Desrochers |
| 4,834,429 | A | 5/1989 | Miller |
| 4,967,048 | A | 10/1990 | Langston |
| 5,042,594 | A | 8/1991 | Gonzalez et al. |
| 5,204,499 | A | 4/1993 | Avalora |
| 5,214,236 | A | 5/1993 | Murphy et al. |
| 5,223,665 | A | 6/1993 | Burleson |
| 5,358,418 | A | 10/1994 | Carmichael |
| 5,396,951 | A | 3/1995 | Ross |
| 5,520,114 | A | 5/1996 | Guimard |
| 5,571,986 | A | 11/1996 | Snider et al. |
| 5,911,277 | A | 6/1999 | Hromas et al. |
| 6,085,659 | A | 7/2000 | Beukes |
| 6,105,688 | A | 8/2000 | Vaynshteyn et al. |

(Continued)

FOREIGN PATENT DOCUMENTS

| | | |
|---|---|---|
| CA | 2224870 | 6/1999 |
| CA | 2521825 | 3/2007 |

(Continued)

OTHER PUBLICATIONS

Baker Hughes; Jim Giliat et al., "New Select-Fire System; Improved Reliability and Safety in Select Fire Operations", 2012.

(Continued)

*Primary Examiner* — Steven A Macdonald
(74) *Attorney, Agent, or Firm* — Morgan, Lewis & Bockius LLP

(57) ABSTRACT

An apparatus and methods for setting a plug in a well may comprise a power charge adapter comprising a housing, a switch and igniter disposed within the housing, and a zero-tension connector configured to provide a reliable electrical connection to the switch. The switch may be an addressable switch. The power charge adapter may include an adapter comprising a substantially cylindrical body that may be configured to engage a downhole end of the housing and an uphole end of a power charge.

17 Claims, 17 Drawing Sheets

(56) References Cited

U.S. PATENT DOCUMENTS 6,116,807 A 9/2000 Dzurko
6,148,263 A 11/2000 Brooks et al.
6,164,375 A 12/2000 Carisella
6,179,064 B1 1/2001 Vaynschteyn
6,257,331 B1 7/2001 Blount et al.
6,283,227 B1 9/2001 Lerche et al.
6,315,043 B1 11/2001 Farrant et al.
6,604,584 B2 8/2003 Lerche et al.
6,618,237 B2 9/2003 Eddy et al.
6,837,310 B2 1/2005 Martin
6,851,471 B2 2/2005 Barlow et al.
6,938,689 B2 9/2005 Farrant et al.
6,957,968 B1 10/2005 Gretz
7,007,756 B2 3/2006 Lerche et al.
7,116,542 B2 10/2006 Lerche et al.
7,301,750 B2 11/2007 DeVries et al.
7,322,416 B2 1/2008 Burris, II
7,336,474 B2 2/2008 Lerche et al.
7,347,278 B2 3/2008 Lerche et al.
7,383,882 B2 6/2008 Lerche et al.
7,445,042 B2 11/2008 Freer et al.
7,505,244 B2 3/2009 Lerche et al.
7,520,323 B2 4/2009 Lerche et al.
7,565,927 B2 7/2009 Gerez et al.
7,708,489 B2 5/2010 Trotter et al.
7,789,153 B2 9/2010 Prinz et al.
7,802,619 B2 9/2010 Hurst et al.
7,862,090 B1 1/2011 Foreman
7,980,309 B2 7/2011 Crawford
8,230,788 B2 7/2012 Brooks et al.
8,387,533 B2 3/2013 Runkel
8,576,090 B2 11/2013 Lerche et al.
8,689,868 B2 4/2014 Lerche et al.
8,875,787 B2 11/2014 Tassaroli
8,884,778 B2 11/2014 Lerche et al.
8,931,389 B2 1/2015 Brooks et al.
8,943,943 B2 2/2015 Tassaroli
9,022,108 B2 5/2015 Chatelet et al.
9,080,433 B2 7/2015 Lanclos et al.
9,145,764 B2 9/2015 Burton et al.
9,157,718 B2 10/2015 Ross
9,181,790 B2 11/2015 Mace et al.
9,194,219 B1 11/2015 Hardesty et al.
9,366,518 B2 6/2016 Guyon et al.
9,441,465 B2 9/2016 Tassaroli
9,464,508 B2 10/2016 Lerche et al.
9,476,289 B2 10/2016 Wells
9,518,454 B2 12/2016 Current et al.
9,581,422 B2 2/2017 Preiss et al.
9,598,942 B2 3/2017 Wells
9,689,223 B2 6/2017 Schacherer et al.
9,689,238 B2 6/2017 Hardesty et al.
9,689,239 B2 6/2017 Hardesty
9,759,049 B2 9/2017 Hardesty et al.
9,759,050 B2 9/2017 Hardesty et al.
9,784,549 B2 10/2017 Eitschberger
9,822,618 B2 11/2017 Eitschberger
9,835,015 B2 12/2017 Hardesty
9,903,192 B2 2/2018 Entchev et al.
9,915,513 B1 3/2018 Zemla et al.
10,036,236 B1 7/2018 Sullivan
10,047,592 B2 8/2018 Burgos et al.
10,161,733 B2 12/2018 Eitschberger et al.
10,174,595 B2 1/2019 Knight
10,180,050 B2 1/2019 Hardesty
10,309,199 B2 6/2019 Eitschberger
10,329,890 B2 6/2019 Mace et al.
10,352,144 B2 7/2019 Entchev et al.
10,408,024 B2 9/2019 Hardesty
10,465,462 B2 11/2019 Frazier et al.
10,472,939 B2 11/2019 Sullivan et al.
10,669,821 B2 6/2020 Knight
10,669,822 B2 6/2020 Eitschberger
10,689,955 B1 6/2020 Mauldin
10,767,453 B2 9/2020 Phelps et al.
10,865,922 B2 12/2020 Corbett
10,914,146 B2 2/2021 Archibald et al.
10,914,147 B2 2/2021 Sullivan et al.
10,920,544 B2 2/2021 Sullivan et al.
11,078,762 B2 8/2021 Mauldin
11,078,765 B2 * 8/2021 Davis ..... E21B 43/119
11,162,334 B2 11/2021 Phelps
11,248,452 B2 2/2022 Sullivan
11,280,166 B2 3/2022 Phelps
11,293,737 B2 4/2022 Sullivan
11,414,951 B2 * 8/2022 Hartman ..... E21B 17/028
11,619,118 B2 * 4/2023 Hardesty ..... E21B 43/11 403/187
11,619,119 B1 4/2023 Roper
11,725,488 B2 8/2023 Phelps
11,761,281 B2 9/2023 Loehken
11,834,935 B2 12/2023 Yang
11,885,216 B2 * 1/2024 Lagrange ..... E21B 47/11
11,906,278 B2 2/2024 Sullivan
11,965,393 B2 * 4/2024 Knight ..... E21B 33/13
12,371,974 B2 * 7/2025 Hardesty ..... E21B 43/116
12,392,216 B2 * 8/2025 Zakharia ..... E21B 23/04
12,404,739 B2 * 9/2025 Knight ..... E21B 33/13
2002/0062991 A1 5/2002 Farrant et al.
2002/0088620 A1 7/2002 Lerche et al.
2003/0029344 A1 2/2003 Eddy et al.
2004/0020392 A1 2/2004 DeVries
2004/0108114 A1 6/2004 Lerche et al.
2005/0045331 A1 3/2005 Lerche et al.
2005/0197781 A1 9/2005 Harmon et al.
2005/0241824 A1 11/2005 Burris et al.
2005/0252403 A1 11/2005 DeVries et al.
2007/0120362 A1 5/2007 Poder
2007/0125540 A1 6/2007 Gerez et al.
2008/0003894 A1 1/2008 Hall et al.
2008/0110612 A1 5/2008 Prinz et al.
2008/0284163 A1 11/2008 Proulx et al.
2009/0272529 A1 11/2009 Crawford
2010/0000789 A1 1/2010 Barton
2010/0051265 A1 3/2010 Hurst et al.
2011/0024116 A1 2/2011 McCann et al.
2011/0066378 A1 3/2011 Lerche et al.
2012/0199352 A1 8/2012 Lanclos et al.
2012/0247769 A1 10/2012 Schacherer et al.
2012/0255842 A1 10/2012 Runkel
2012/0325463 A1 12/2012 Chatelet et al.
2013/0043074 A1 2/2013 Tassaroli
2013/0120112 A1 5/2013 Zhao
2013/0126237 A1 5/2013 Burton et al.
2013/0199843 A1 8/2013 Ross
2014/0083718 A1 3/2014 Bell
2014/0131035 A1 5/2014 Entchev et al.
2014/0151018 A1 6/2014 Lerche et al.
2014/0338552 A1 11/2014 Mace et al.
2014/0352981 A1 12/2014 Fripp
2015/0000509 A1 1/2015 Current et al.
2015/0007740 A1 1/2015 Guyon et al.
2015/0068723 A1 3/2015 Wells
2015/0096752 A1 4/2015 Burgos et al.
2015/0107852 A1 4/2015 Southgate et al.
2015/0145243 A1 5/2015 Dude
2015/0292318 A1 10/2015 Senger
2015/0292849 A1 10/2015 Lerche et al.
2015/0321800 A1 11/2015 Viale et al.
2015/0330192 A1 11/2015 Rogman et al.
2015/0345922 A1 12/2015 Lanclos et al.
2016/0115753 A1 4/2016 Frazier et al.
2016/0202033 A1 7/2016 Shahinpour
2016/0245054 A1 8/2016 Hardesty et al.
2016/0245056 A1 8/2016 Hardesty et al.
2016/0245057 A1 8/2016 Hardesty
2016/0245058 A1 8/2016 Hardesty et al.
2016/0273902 A1 9/2016 Eitschberger
2016/0333676 A1 11/2016 Hardesty
2016/0356132 A1 12/2016 Burmeister et al.
2017/0009560 A1 1/2017 Wells
2017/0030167 A1 2/2017 Hardesty
2017/0044865 A1 2/2017 Sabins et al.
2017/0051586 A1 2/2017 Wells et al.

(56) References Cited

U.S. PATENT DOCUMENTS

| | | | |
|---|---|---|---|
| 2017/0074078 | A1 | 3/2017 | Eitschberger |
| 2017/0138164 | A1 | 5/2017 | Mace et al. |
| 2018/0038208 | A1 | 2/2018 | Eitschberger |
| 2018/0094511 | A1 | 4/2018 | Hardesty |
| 2018/0119530 | A1 | 5/2018 | Skinner et al. |
| 2018/0135389 | A1 | 5/2018 | Sullivan |
| 2018/0135398 | A1 | 5/2018 | Entchev et al. |
| 2018/0299239 | A1 | 10/2018 | Eitschberger et al. |
| 2019/0048693 | A1 | 2/2019 | Henke |
| 2019/0048694 | A1 | 2/2019 | Sullivan et al. |
| 2019/0085664 | A1* | 3/2019 | Hardesty ..... E21B 43/1185 |
| 2019/0086189 | A1 | 3/2019 | Eitschberger et al. |
| 2019/0106969 | A1 | 4/2019 | Sullivan et al. |
| 2019/0136673 | A1 | 5/2019 | Sullivan et al. |
| 2019/0153827 | A1 | 5/2019 | Goyeneche |
| 2019/0162057 | A1 | 5/2019 | Montoya Ashton et al. |
| 2019/0257181 | A1 | 8/2019 | Langford et al. |
| 2019/0309608 | A1 | 10/2019 | Phelps et al. |
| 2019/0323810 | A1 | 10/2019 | Saltarelli et al. |
| 2019/0330961 | A1 | 10/2019 | Knight et al. |
| 2019/0360315 | A1 | 11/2019 | Hardesty |
| 2019/0390536 | A1 | 12/2019 | Archibald et al. |
| 2020/0018584 | A1 | 1/2020 | Phelps et al. |
| 2020/0378222 | A1 | 12/2020 | Phelps |
| 2021/0396102 | A1 | 12/2021 | Phelps et al. |
| 2022/0162926 | A1 | 5/2022 | Phelps |
| 2023/0203921 | A1 | 6/2023 | Hardesty et al. |
| 2023/0340862 | A1 | 10/2023 | Phelps et al. |
| 2024/0254846 | A1* | 8/2024 | Bryant ..... E21B 23/0414 |
| 2025/0305395 | A1* | 10/2025 | Hardesty ..... E21B 43/119 |

FOREIGN PATENT DOCUMENTS

| | | |
|---|---|---|
| CN | 101397890 | 4/2009 |
| CN | 202628049 | 12/2012 |
| EP | 1394457 | 5/1975 |
| EP | 1293394 | 3/2003 |
| GB | 242588 | 3/1925 |
| GB | 2544247 | 5/1975 |
| GB | 2513934 | 11/2014 |
| WO | 0024999 | 5/2000 |
| WO | 2012161854 | 11/2012 |
| WO | 2013106850 | 7/2013 |
| WO | 2015052509 | 4/2015 |
| WO | 2017192878 | 11/2017 |

OTHER PUBLICATIONS

China National Intellectual Property Administration; 201810895522.0, dated May 14, 2019, including English Translation, First Office Action and Search Report for related CN Appn No.

DYNAenergetics, "Selective Perforating Switch", brochure May 11, 2027 sales@dyaenergetics.com/www.dynaenergetics.com, retrieved from internet on May 21, 2019.

Dynaenergetics "Electronic Top Fire Detonator"; Revised Jul. 13, 2030, retrieved from internet on May 21, 2019.

Dynaenergetics—"DynaSelect Electronic Detonator" 0015 SFDE RDX 1.4S, Brochure; www.dynaenergetics.com; performance@dynaenergetics.com, Revised Apr. 12, 2003—retrieved from internet on May 21, 2019.

Dynaenergetics—"DynaSelect System Detonator" 0015 SFDE RDX 1.4B, brochure www.dynaenergetics.com; performance@dynaenergetics.com; Revised Apr. 12, 2003—retrieved from internet on May 21, 2019.

Dynaenergetics—Dynawell—"Gun Assembly", www.dynaeneergetics.com; dynawell@dynaenergetics.com, retrieved from internet on May 21, 2019.

DYNAselect System—text; no other information, retrieved from internet on May 21, 2019.

European Patent Office; 18187649.1-1022/ 3453826, Communication dated Apr. 26, 2019.

European Patent Office; 20163387.2-1002 / 3686395, Communication dated Sep. 21, 2020.

European Patent Office; 18856294.6-1005 /3682088; PCT/US2018047592, Partial Supplementary European Search report dated May 28, 2021.

European Patent Office; 18856294.6-1005/ 3682088 PCT/US2018047592, Communication dated Aug. 30, 2021.

European Patent Office; 18856294.6-1002, Communication Pursuant to Article 94(3) EPC, dated Mar. 22, 2023.

Hunting; "Wireline Top Fire Detonator Systems", brochure, Right Tools Right Location Right Time 49, retrieved from internet on May 21, 2019.

International Search Report and Written Opinion; PCT/US18/47592, dated Jan. 20, 2019.

International Search Report and Written Opinion; PCT/US18/22846, dated Jul. 26, 2018.

USPTO; Office Action, U.S. Appl. No. 15/848,039, mailed Mar. 13, 2018.

USPTO; Office Action, U.S. Appl. No. 16/019,767, mailed Apr. 12, 2019.

USPTO; Office Action, U.S. Appl. No. 16/419,306, mailed Feb. 6, 2020.

USPTO; Office Action, U.S. Appl. No. 16/214,301; mailed Jul. 2, 2020 (Except for the references cited herein, the remaining references cited in the US Office Action are already of record).

USPTO; Office Action, U.S. Appl. No. 16/240,942; mailed Jul. 14, 2020 (Except for the references cited herein, the remaining references cited in the US Office Action are already of record).

USPTO; Office Action, U.S. Appl. No. 16/581,928, mailed Feb. 8, 2021.

USPTO; Office Action, U.S. Appl. No. 16/462,648, mailed May 7, 2021.

USPTO; Office Action, U.S. Appl. No. 16/462,648, dated Aug. 23, 2021.

* cited by examiner

PRIOR ART

PRIOR ART

POWER CHARGE ADAPTER

TECHNICAL FIELD

The present disclosure relates generally to perforating guns and associated fracturing operations, and more specifically, to methods and systems for activating a setting tool to plug a well.

BACKGROUND OF THE INVENTION

In the oil and gas field, once a well 100 is drilled to a desired depth H relative to the surface 110, as illustrated in FIG. 1, and the casing 102 protecting the wellbore 104 has been installed and cemented in place, it is time to connect the wellbore 104 to the subterranean formation 106 to extract the oil and/or gas. This process of connecting the wellbore to the subterranean formation may include a step of plugging the well with a plug 112, a step of perforating the casing 102 with a perforating gun assembly 114 such that various channels 116 are formed to connect the subterranean formation to the inside of the casing 102, a step of removing the perforating gun assembly, and a step of fracturing the various channels 116.

Some of these steps require to lower in the well 100 a wireline 118, which is electrically and mechanically connected to the perforating gun assembly 114, and to activate the gun assembly and/or a setting tool 120 attached to the perforating gun assembly. Setting tool 120 is configured to hold plug 112 prior to plugging the well. FIG. 1 shows the setting tool 120 disconnected from the plug 112, indicating that the plug has been set in the casing and the setting tool 120 has been disconnected from the plug 112.

FIG. 1 shows the wireline 118, which includes at least one electrical connector, being connected to a control interface 122, located on the ground 110, above the well 100. An operator of the control interface may send electrical signals to the perforating gun assembly and/or setting tool for (1) setting the plug 112 and (2) disconnecting the setting tool from the plug. A fluid 124, (e.g., water, water and sand, fracturing fluid, etc.) may be pumped by a pumping system 126, down the well, for moving the perforating gun assembly and the setting tool to a desired location, e.g., where the plug 112 needs to be deployed, and also for fracturing purposes.

The above operations may be repeated multiple times for perforating the casing at multiple locations, corresponding to different stages of the casing. Note that in this case, multiple plugs 112 and 112' may be used for isolating the respective stages from each other during the perforating phase and/or fracturing phase.

FIG. 2 shows a traditional perforating gun assembly and setting tool system 200. From left to right, FIG. 2 shows a perforating gun assembly 214, a switch sub 228, an adapter 252, a setting assembly 254, a quick change tool 240, a setting tool 220, a setting tool assembly kit 255, and a plug 211. These devices are mechanically connected to each other in the order shown in the figure. The quick change tool 240 is made of two parts 240A and 240B that can rotate one with respect to the other. This means that there is no need to rotate the perforating gun assembly and the setting tool when connecting them to each other as the quick change tool performs that function. The quick change tool 240 is connected to the perforating gun assembly 214 through the switch sub 228. The switch sub 228 houses a switch (not shown) that activates a detonator 215 of the perforating gun assembly. An igniter 221, which activates the setting tool, is located in a firing head 224 within the setting tool 220.

The system 201 shown in FIG. 2 is both complex (many parts that have to be connected together, which means valuable time being spent on assembling the tool and not on extracting the oil and gas) and large (which means that the system is expensive as each part requires special manufacturing and care). One previous attempt to address these deficiencies was the applicant's U.S. Pat. No. 10,036,236. FIG. 3 depicts one embodiment of the device described in this reference. In this device, downhole tool 300 used to plug a well and/or to perforate a casing placed in the well includes a perforating gun assembly 310, a switch sub 330, an adapter 360, a setting tool 370 and a plug 390. These elements are connected to each other in this order and as shown in the figure. Comparative to the system 201 shown in FIG. 2, the system shown in FIG. 3 includes fewer components (only four instead of six) and is easier to assemble.

More specifically, the embodiment shown in FIG. 3 has an igniter system 320 placed in a bulkhead 344 formed in a body 332 of the switch sub 330. As shown, the bulkhead is part of the body 332 of the switch sub, i.e., it is made integrally in the body. In this way, the bulkhead can withstand a detonation of an adjacent gun without being deformed and without allowing smoke or soot to pass by. The switch sub 330 also has a bore/chamber 340. The bulkhead 344 has a bulkhead bore 345 that fluidly communicates with the bore/chamber 340 and extends along a longitudinal axis X. Body 332 of the switch sub 330 has a first end that faces the perforating gun assembly 310 and a second end that faces the adapter 360. Body 332 has a first threaded region, for mate coupling with the perforating gun assembly 310. Body 332 also has a second threaded region 336, for mate coupling with the adapter 360. Various recesses are formed in the body 332, at each of the two ends for receiving O-rings 380B and 380C to achieve a seal between the perforating gun assembly and the switch sub, and another seal between the adaptor and the switch sub.

The bore/chamber 340 is formed inside body 332 and connects to the perforating gun assembly 310. Bore/chamber 340 is constricted toward the adapter 360 to a small bore, that allows one or more electrical wires (e.g., wires 322 and 324) to pass from bulkhead bore 345 to bore/chamber 340. Igniter system 320 is designed to snugly fit inside bulkhead bore 345 as shown in FIG. 3.

The igniter system 320 may have two wires, a ground wire 322 and a signal wire 324. FIG. 3 shows that an opening 343 is formed in the body 332 of the switch sub 330, and this opening may be closed with a cap 345. This opening may be used for forming electrical contacts between the wires of the igniter system and a switch and/or detonator. Bore/chamber 340 may house various electronic components, e.g., switch 346 that sends the firing signal to the igniter system 320. In one application, switch 346 may also send a firing signal to a detonator 312, located inside perforating gun assembly 310. Detonator 312, when activated, may detonate a detonator cord 314 for firing the various shaped charges (not shown) of the perforating gun assembly 310.

Still with regard to FIG. 3, a cartridge 350 (for example, made out of copper) may be attached to or may be part of the igniter system. Cartridge 350 may include an energetic material 352, which produces the flame that would ignite a power charge 376 located inside the setting tool 370. The igniter system 320 and cartridge 350 are locked inside the bulkhead bore 345 with a nut 354. Thus, in this embodiment, the entire igniter system 320 is located in the second end 332B of the switch sub 330. This means that switch sub 330 now includes not only the switch 346, but also the igniter system 320.

Although the design shown in FIG. 3 simplifies existing setting tools, it still suffers from several deficiencies. For example, although the switch and the igniter system are both disposed within the switch sub, they are still structurally separate components. Accordingly, these two components must be separately installed and/or replaced. In addition, due in part to the aforementioned issue, the igniter system and the switch are connected by wires, which are prone to being incorrectly installed or becoming inadvertently disconnected after installation. Furthermore, although it is disclosed in U.S. Pat. No. 10,920,544 that switch 346 depicted in FIG. 3 may be addressable, conventional addressable switches provide limited flexibility because a switch programmed to be used with a setting tool cannot later be modified to be used with a perforating gun, and vice versa.

Thus, it is desirable to develop an improved setting tool system that addresses one or more of the foregoing issues, in addition to other issues.

SUMMARY OF THE INVENTION

One or more embodiments of the invention, a power charge adapter may comprise a first substantially cylindrical housing comprising a first end, a second end comprising a throughbore and an internal cavity; a cap coupled to the first end of the first housing and comprising a recessed region; an adapter comprising a substantially cylindrical body configured to engage an outer surface of the second end of the first housing; a switch disposed within the cavity of the first housing; an igniter disposed within the throughbore of the second end of the first housing; and a zero-tension connector disposed within the recessed region of the cap and comprising a second substantially cylindrical housing comprising a first end, a second end comprising a throughbore and an internal cavity, a sliding contact disposed within the cavity of the second housing, wherein the sliding contact comprises a body with a first end opposite a second end, and wherein a portion of the first end of the sliding contact is exposed at the first end of the second housing, a first spring provided within the cavity of the second housing and configured to bias the sliding contact against the first end of the second housing, and an electrical contact disposed at least partially within the throughbore of the second end of the second housing and comprising a first end connected to the second end of the sliding contact and a second end connected to the switch.

In one or more embodiments, the switch may be addressable.

In one or more embodiments, the switch may comprise an interface (I/O) configured to connect to a surface controller along a telemetry system and a processor connected to the interface (I/O) and configured to receive a command from the surface controller, along the telemetry system, to change a first value of a mode status variable to a desired second value, wherein the first value is associated with a first operating mode of the switch and the second value is associated with a second operating mode, which is different from the first operating mode; change the first value to the second value; and store in a non-volatile memory the second value of the mode status variable.

In one or more embodiments, the steps of changing and storing may take place while the switch assembly is located at the surface.

In one or more embodiments, each of the first and second operating modes may be one of a standard operating mode and a set/fire operating mode.

In another embodiment of the invention, a downhole tool may comprise a tandem sub comprising a first threaded surface and an electrical contact; a firing head comprising a throughbore and second threaded surface configured to engage the first threaded surface; a power charge adapter disposed within the throughbore of the firing head and comprising a first substantially cylindrical housing comprising a first end, a second end comprising a throughbore and an internal cavity, a cap coupled to the first end of the first housing and comprising a recessed region, an adapter comprising a substantially cylindrical body configured to engage an outer surface of the second end of the first housing, a switch disposed within the cavity of the first housing, an igniter disposed within the throughbore of the second end of the first housing, a zero-tension connector disposed within the recessed region of the cap and comprising a second substantially cylindrical housing comprising a first end, a second end comprising a throughbore and an internal cavity, a sliding contact disposed within the cavity of the second housing, wherein the sliding contact comprises a body with a first end opposite a second end, and wherein a portion of the first end of the sliding contact is connected to the electrical contact of the tandem sub, a first spring provided within the cavity of the second housing and configured to bias the sliding contact against the first end of the second housing, and an electrical contact disposed at least partially within the throughbore of the second end of the second housing and comprising a first end connected to the second end of the sliding contact and a second end connected to the switch; and a second spring compressed by the tandem sub and configured to bias the zero-tension connector towards the recessed region of the cap of the power charge adapter.

In another embodiment of the invention, a downhole system may comprise a tandem sub comprising a first threaded surface and an electrical contact; a firing head comprising a throughbore and second threaded surface configured to engage the first threaded surface; a power charge adapter disposed within the throughbore of the firing head and comprising a first substantially cylindrical housing comprising a first end, a second end comprising a throughbore and an internal cavity, a cap coupled to the first end of the first housing and comprising a recessed region, an adapter comprising a substantially cylindrical body configured to engage an outer surface of the second end of the first housing, a switch disposed within the cavity of the first housing, an igniter disposed within the throughbore of the second end of the first housing; a zero-tension connector disposed within the recessed region of the cap and comprising a second substantially cylindrical housing comprising a first end, a second end comprising a throughbore and an internal cavity, a sliding contact disposed within the cavity of the second housing, wherein the sliding contact comprises a body with a first end opposite a second end, and wherein a portion of the first end of the sliding contact is connected to the electrical contact of the tandem sub, a first spring provided within the cavity of the second housing and configured to bias the sliding contact against the first end of the second housing, and an electrical contact disposed at least partially within the throughbore of the second end of the second housing and comprising a first end connected to second end of the sliding contact and a second end connected to the switch; a second spring compressed by the tandem sub and configured to bias the zero-tension connector towards the recessed region of the cap of the power charge adapter; and a setting tool configured to engage the firing head and comprising a power charge, wherein the body of the adapter is configured to engage an outer surface of the power charge, such that the igniter is disposed in proximity to the power charge.

In another embodiment of the invention, a method of setting a downhole plug may comprise connecting a downhole end of a tandem sub to an uphole end of a firing head; connecting a downhole end of the firing head to an uphole end of a setting tool; and sending a signal configured to activate a switch, wherein the tandem sub comprises an electrical contact; the firing head comprises a throughbore; a power charge adapter is disposed within the throughbore of the firing head and comprises a first substantially cylindrical housing comprising a first end, a second end comprising a throughbore and an internal cavity, a cap coupled to the first end of the first housing and comprising a recessed region, an adapter comprising a substantially cylindrical body configured to engage an outer surface of the second end of the first housing, the switch, which is disposed within the cavity of the first housing, an igniter disposed within the throughbore of the second end of the first housing; a zero-tension connector disposed within the recessed region of the cap and comprising a second substantially cylindrical housing comprising a first end, a second end comprising a throughbore and an internal cavity, a sliding contact disposed within the cavity of the second housing, wherein the sliding contact comprises a body with a first end opposite a second end, and wherein a portion of the first end of the sliding contact is connected to the electrical contact of the tandem sub, a first spring provided within the cavity of the second housing and configured to bias the sliding contact against the first end of the second housing, and an electrical contact disposed at least partially within the throughbore of the second end of the second housing and comprising a first end connected to the second end of the sliding contact and a second end connected to the switch; a second spring compressed by the tandem sub and configured to bias the zero-tension connector towards the recessed region of the cap of the power charge adapter; and a setting tool configured to engage the firing head and comprising a power charge, wherein the body of the adapter is configured to engage an outer surface of the power charge, such that the igniter is disposed in proximity to the power charge and the step of sending a signal configured to activate a switch results in ignition of the power charge.

BRIEF DESCRIPTION OF DRAWINGS

The accompanying drawings, which are included to provide further understanding and are incorporated in and constitute a part of this specification, illustrate disclosed embodiments and together with the description serve to explain the principles of the disclosed embodiments. In the drawings.

DETAILED DESCRIPTION OF THE INVENTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a perforating gun assembly attached to a setting tool through a switch sub and an adapter. However, the embodiments discussed herein are not limited to such elements.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 4:
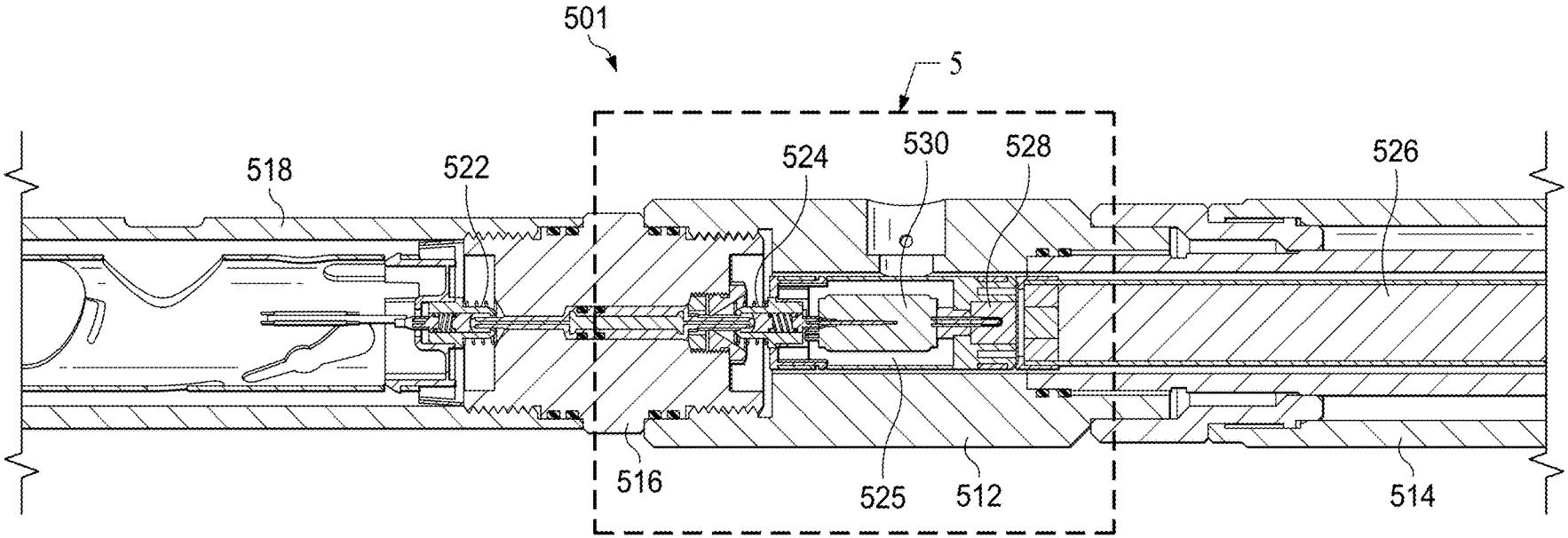
FIG. 4 depicts a downhole tool in accordance with an illustrative embodiment of the present invention.

According to the illustrative embodiment in FIG. 4, a perforating system 501 may comprise a firing head 512, a setting tool 514, a tandem sub 516, a perforating gun 518, and a power charge adapter 525. Tandem sub 516 is disposed between perforating gun 518 and firing head 512, and facilitates a reliable electrical connection via uphole contact 522 and downhole contact 524, as discussed below in further detail. Disposed within firing head 512 is power charge adapter 525, also as discussed below in further detail. Disposed within setting tool 514 is power charge 526. Igniter 528 is disposed within power charge adapter 525 and configured to ignite power charge 526, as further discussed below.

Figure 5:
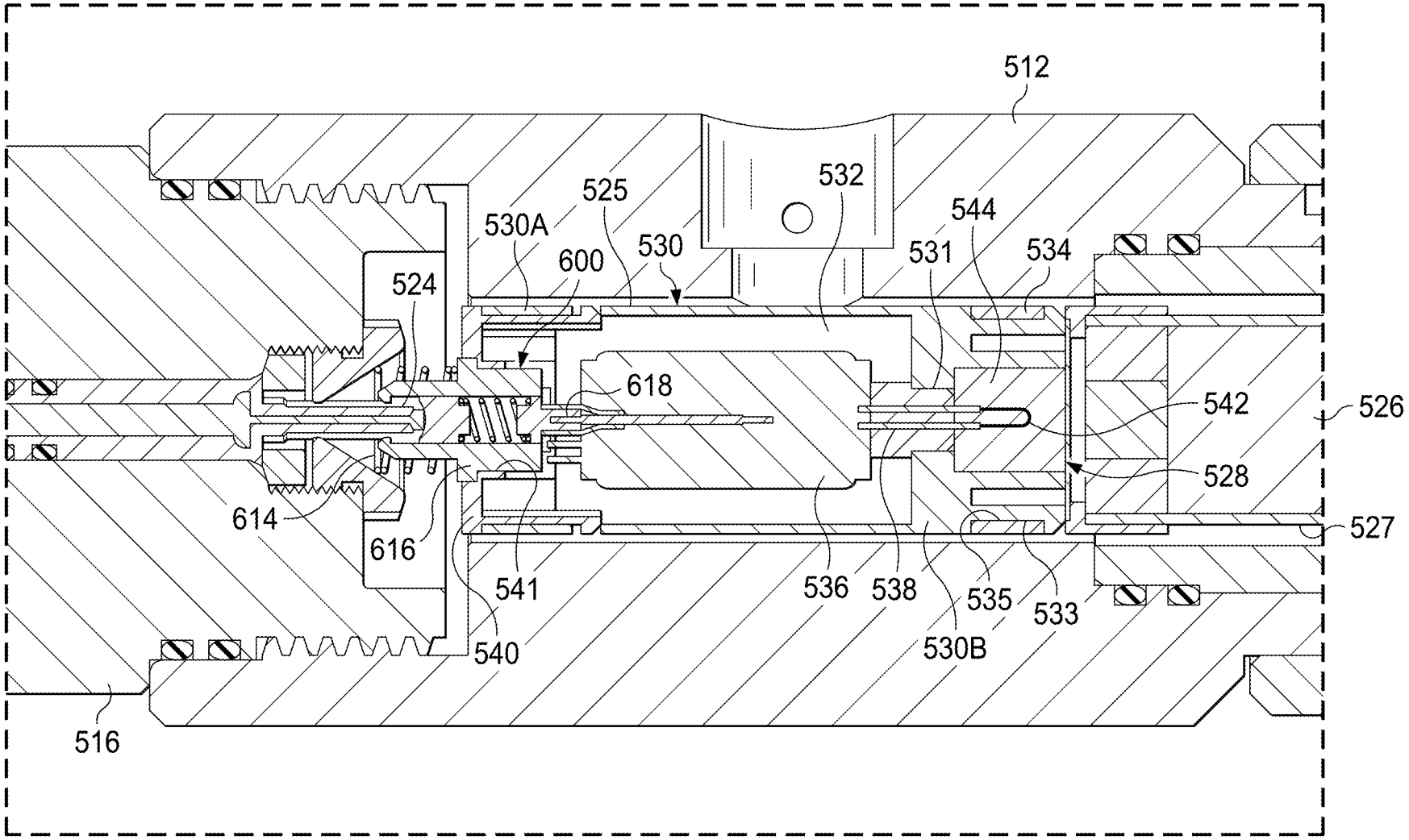
FIG. 5 depicts a power charge adapter in accordance with an illustrative embodiment of the present invention.

As shown in FIG. 5, disposed within firing head 512 is power charge adapter 525. Power charge adapter 525 may comprise housing 530 and internal cavity 532. Housing 530 may comprise an uphole end 530A and a downhole end 530B.

Uphole end 530A of housing 530 may be configured to engage with cap 540, which is in turn configured to engage with zero-tension connector 600. Cap 540 may be coupled to housing 530 and may comprise recessed region 541, which is configured to accommodate zero-tension connector 600, as shown in FIG. 5. Zero-tension connector 600 may be held in place by biasing member 614, which may be a coiled spring, as further discussed below. Biasing member 614 may be compressed between a retaining nut in a downhole end of tandem sub 516 and an uphole surface of annular flange 616 of zero-tension connector 600.

Downhole end 530B of housing 530 may comprise outer surface 533 and throughbore 531 configured to accommodate igniter 528. Disposed proximate downhole end 530B of housing 530 may be adapter 534, a substantially cylindrical body comprising inner surface 535. An uphole end of inner surface 535 of adapter 534 may be configured to engage outer surface 533 of downhole end 530B of housing 530. A downhole end of inner surface 535 of adapter 534 may be configured to engage an outer surface 527 of power charge 526. In this way, a downhole end of igniter 528 may be disposed in proximity to an uphole end of power charge 526, thus ensuring that ignition of igniter 528 will also result in ignition of power charge 526.

Disposed within internal cavity 532 of housing 530 is switch 536. Electrical connection 538 may connect switch 536 to igniter 528, such that a signal passing through switch 536 will cause the ignition of igniter 528, thus leading to the ignition of power charge 526. Igniter 528 may comprise black powder 544 and heating element 542 configured to ignite black powder 544, as will be understood by one of ordinary skill in the art.

Figure 1:
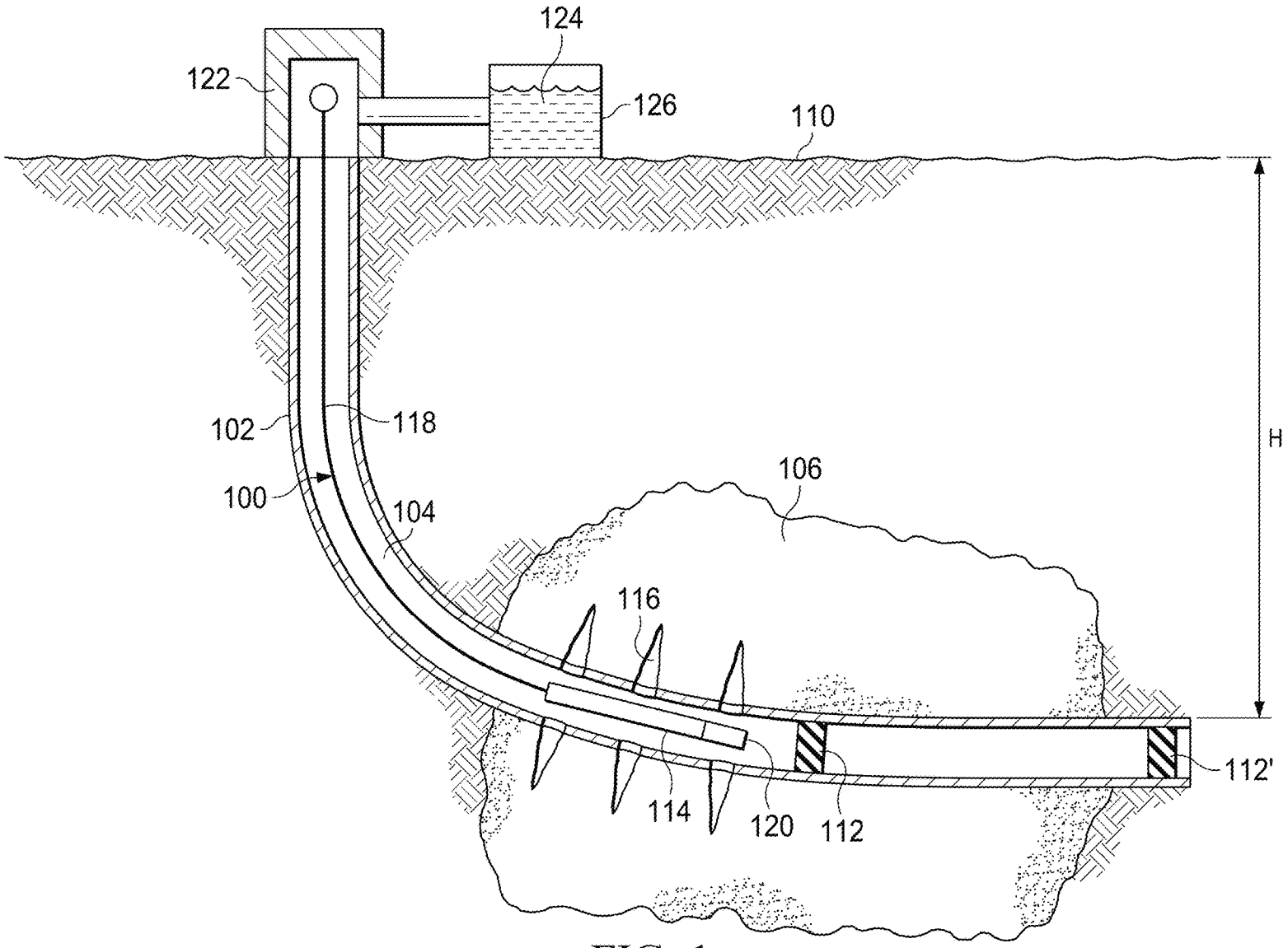
FIG. 1 depicts a well and associated equipment for well completion operations.
Figure 2:
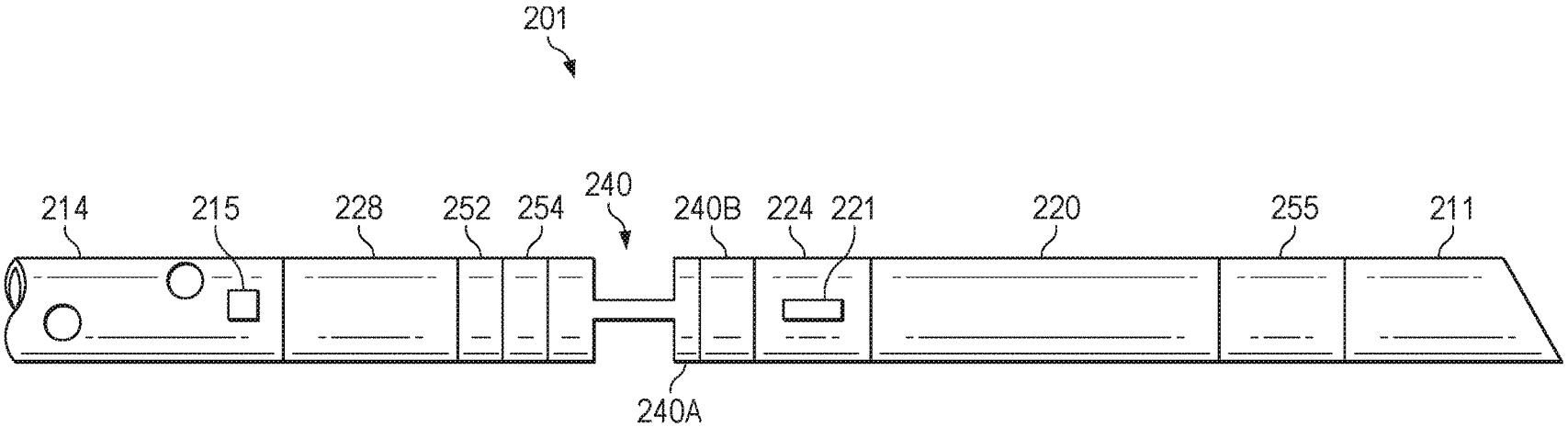
FIG. 2 depicts a traditional perforating gun assembly and tool setting system.
Figure 3:
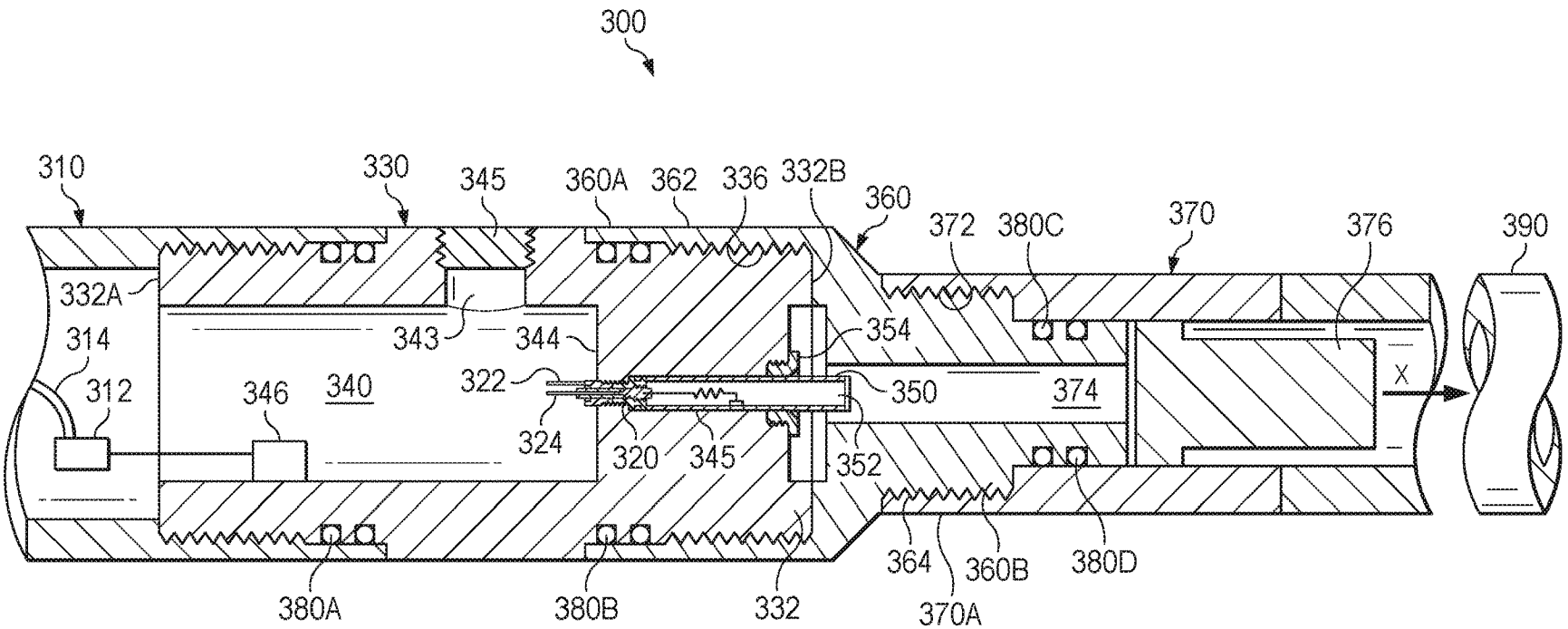
FIG. 3 depicts a prior art perforating system having an igniter system located inside a switch sub.

Power charge 526 is configured such that its ignition will cause setting tool 514 to set a downhole plug, such as plug 112 shown in FIG. 1, plug 211 shown in FIG. 2, or plug 390 shown in FIG. 3. The mechanism by which setting tool 514 sets the plug is well known to those of ordinary skill in the art and will not be further discussed.

Because igniter 528 and switch 536 are disposed within power charge adapter 525, while the power charge itself is disposed within separate component 526, with power charge adapter 525 and power charge 526 connected via adapter 534, the present invention provides increased flexibility in comparison to certain existing products. In particular, U.S. Pat. No. 11,053,783 describes and claims a "power charge cartridge assembly" disposed within a setting tool, wherein both the igniter and the "energetic material" of the power charge are disposed within the same hollow cylindrical housing and an addressable switch is "integral with the power charge." An operator using this device is necessarily required to obtain the switch, igniter, and power charge from the same supplier as part of a single assembly. By contrast, the present invention allows an operator to separately obtain a power charge adapter, including both a switch and igniter, which can be used with a power charge provided by another supplier.

At its uphole end, switch 536 may be connected to electrical contact 618 of zero-tension connector 600. As discussed further below, zero-tension connector 600 may be configured to facilitate a reliable electrical connection between switch 536 and downhole contact 524 of tandem sub 516.

Figure 6:
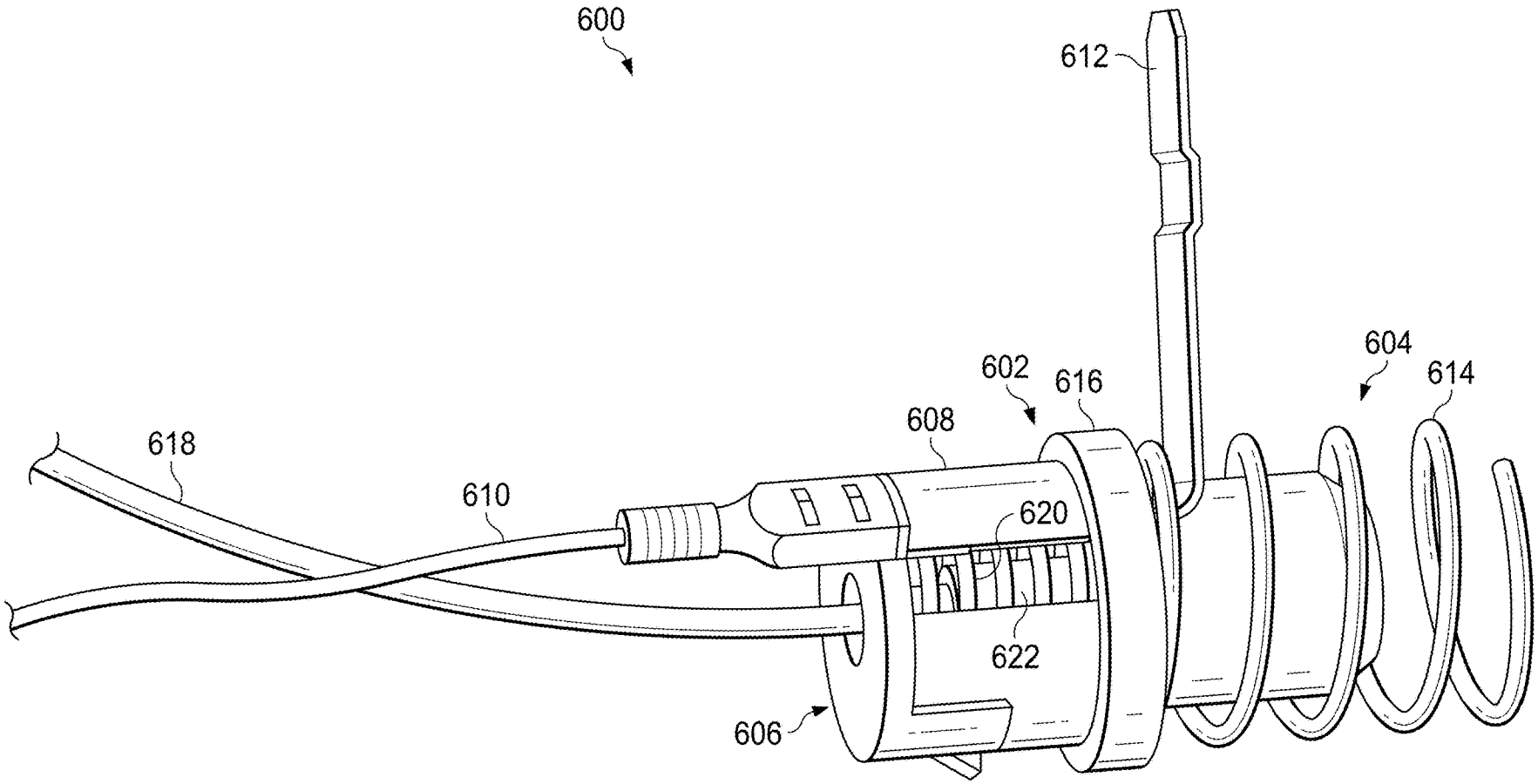
FIG. 6 is a perspective view of a zero-tension connector in accordance with an illustrative embodiment of the present invention.

FIG. 6 is a perspective view of a zero-tension connector in accordance with an illustrative embodiment. Zero-tension connector 600 is generally formed from a housing 602 that has a first end 604 and a second end 606 separated by a sidewall 608. The sidewall 608 defines a cavity that houses a sliding contact 622, both of which are shown in more detail in the exploded view depicted in FIG. 7. In addition, extending from the second end 606 of the housing 602 is a ground wire 610 that is removably attached to a proximal end of a first ground connection 612. In the depicted embodiment, the first ground connection 612 is an elongated metallic tab that is secured with the housing 602 by passing the first ground connection 612 through a slotted aperture in the sidewall 608 of the housing 602. However, this embodiment of first ground connection 612 should be deemed exemplary and non-limiting.

The first ground connection 612 is electrically connected to a second ground connection, which may be a biasing member 614, implemented in this embodiment as a coiled spring. In particular, the first ground connection 612 is wrapped partially around a coil and optionally secured by the application of solder or other form of conducting weld. Where the second ground connection is a coiled spring, it encircles the first end 604 of the housing 602 and one end is positioned against an annular flange 616 encircling the outer surface of the sidewall 608. The other end of the second ground connection extends outwardly beyond the first end 604. When firing head 512 is connected to tandem sub 516, the second ground connection, such as biasing member 614, is compressed by a retaining nut in the downhole end of tandem sub 516.

Also extending from the second end 606 of the housing 602 is electrical contact 618. Electrical contact 618 is connected to a proximal end of a sliding contact 622, which is shown in more detail in FIG. 7. A distal end of the sliding contact 622 is exposed at the first end 604 of the housing 602 to make contact with downhole contact 524 of tandem sub 516. A spring 620 is mounted within the cavity of the housing 602 and disposed between the proximal end of the sliding contact 622 and the housing 602. The spring 620 maintains the sliding contact at the first end 604 of the housing with the proximal end exposed and positioned to receive the downhole contact 524 of tandem sub 516.

Figure 7:
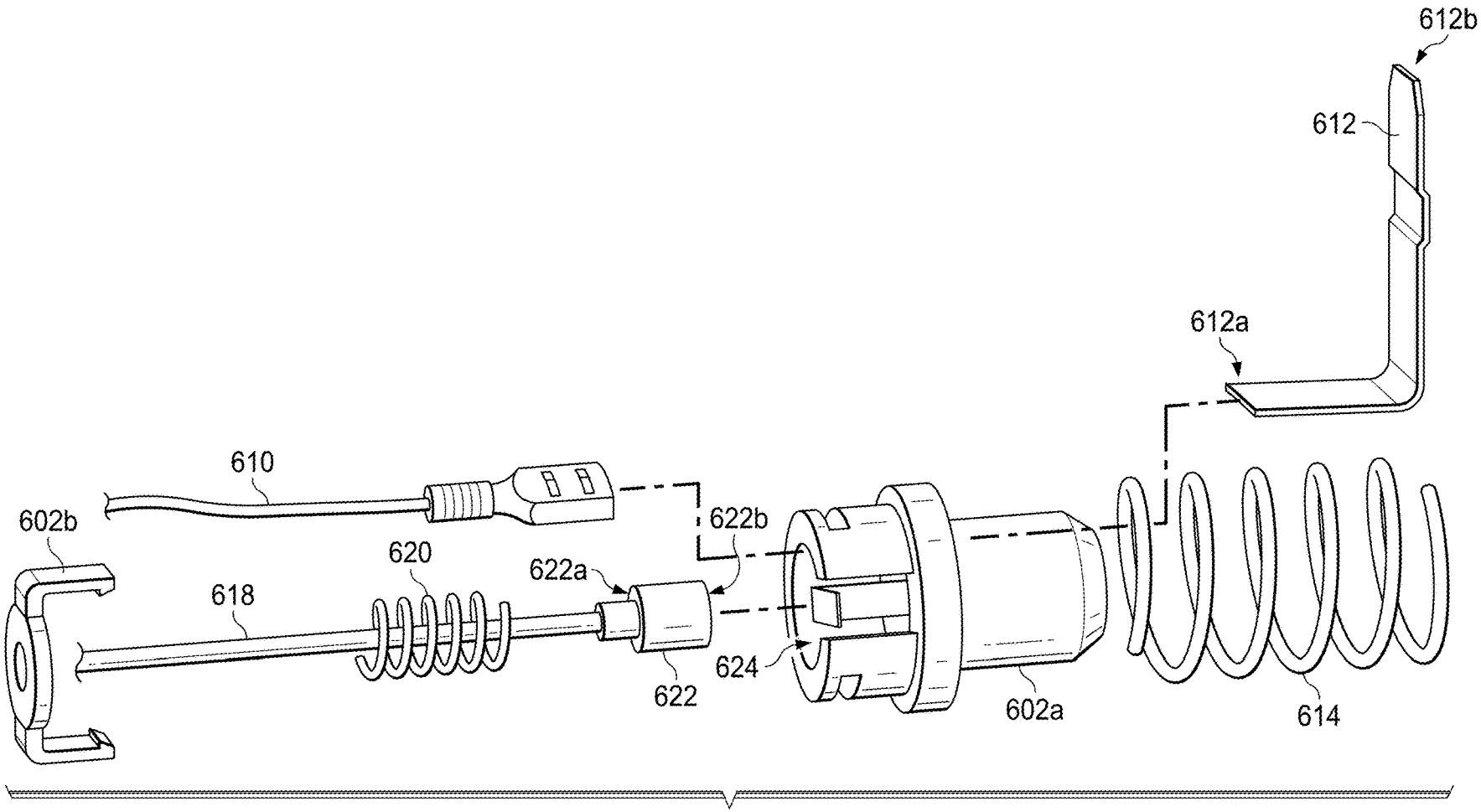
FIG. 7 is an exploded view of a zero-tension connector in accordance with an illustrative embodiment of the present invention.

FIG. 7 is an exploded view of a zero-tension connector in accordance with an illustrative embodiment. The housing 602 of the zero-tension connector 600 is depicted as a plurality of pieces that, when assembled, defines a cavity to house sliding contact 622. In particular, the housing is formed from a body 602*a* that defines cavity 624, which may be sealed by endcap 602*b*. The endcap 602*b* may be secured to the body 602*a* using conventionally available fasteners. For example, in one embodiment the endcap 602*b* may be threaded and configured to be screwed to the body 602, which is counter-threaded. In this illustrative embodiment, the endcap 602*b* includes a set of flexible arms, each with a protruding lip configured to engage a corresponding recess in the sidewall 608 of the body 602*a*.

The sliding contact 622 is housed within the cavity 624. The sliding contact includes a proximal end 622*a* opposite to a distal end 622*b*. In this illustrative embodiment, electrical contact 618 is electrically connected to the proximal end 622*a* of the sliding contact 622 with electrical contact 618 extending out from an aperture in the endcap 602*b*. The spring 620 is oriented along electrical contact 618 and positioned so that the spring 620 is compressible between the proximal end 622*a* of the sliding contact 622 and the interior surface of the endcap 602*b*. As previously mentioned, the spring 620 provides a compressive force that maintains the sliding contact 622 at the first end 604 of the housing 602 to receive downhole contact 524 of tandem sub 516.

The first ground connection 612 is depicted as a metallic tab with a proximal end 612*a* and a distal end 612*b*. In this illustrative embodiment, the first ground connection 612 is wrapped at least partially around a coil in biasing member 614 and optionally soldered together to maintain the electrical connection. In an alternate embodiment, the first ground connection 612 and the biasing member 614 may be a single, integrated component that simplifies installation and obviates the need for a soldered joint.

Figure 8A:
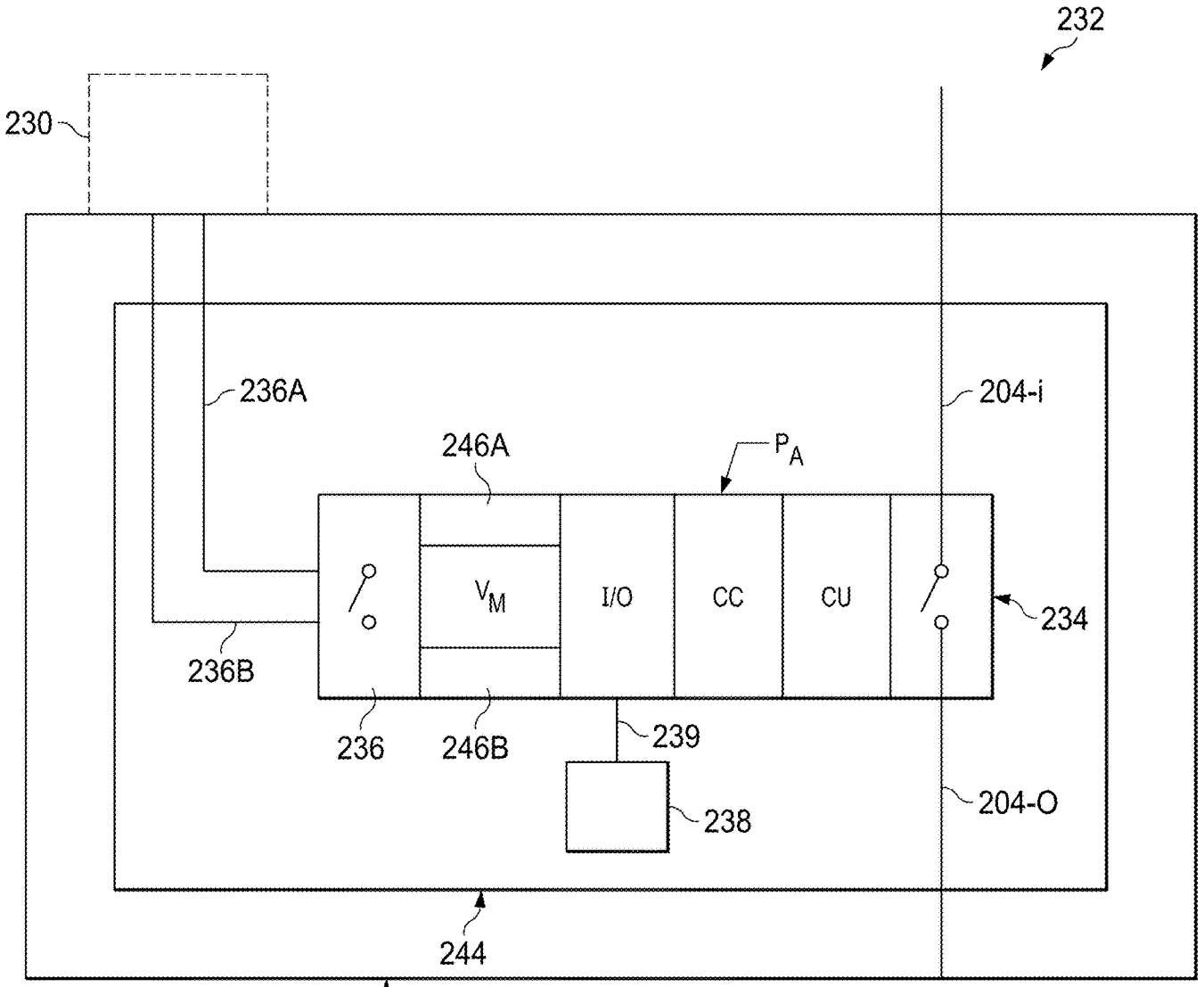
FIGS. 8A and 8B illustrate possible configurations of an addressable switch assembly.
Figure 8B:
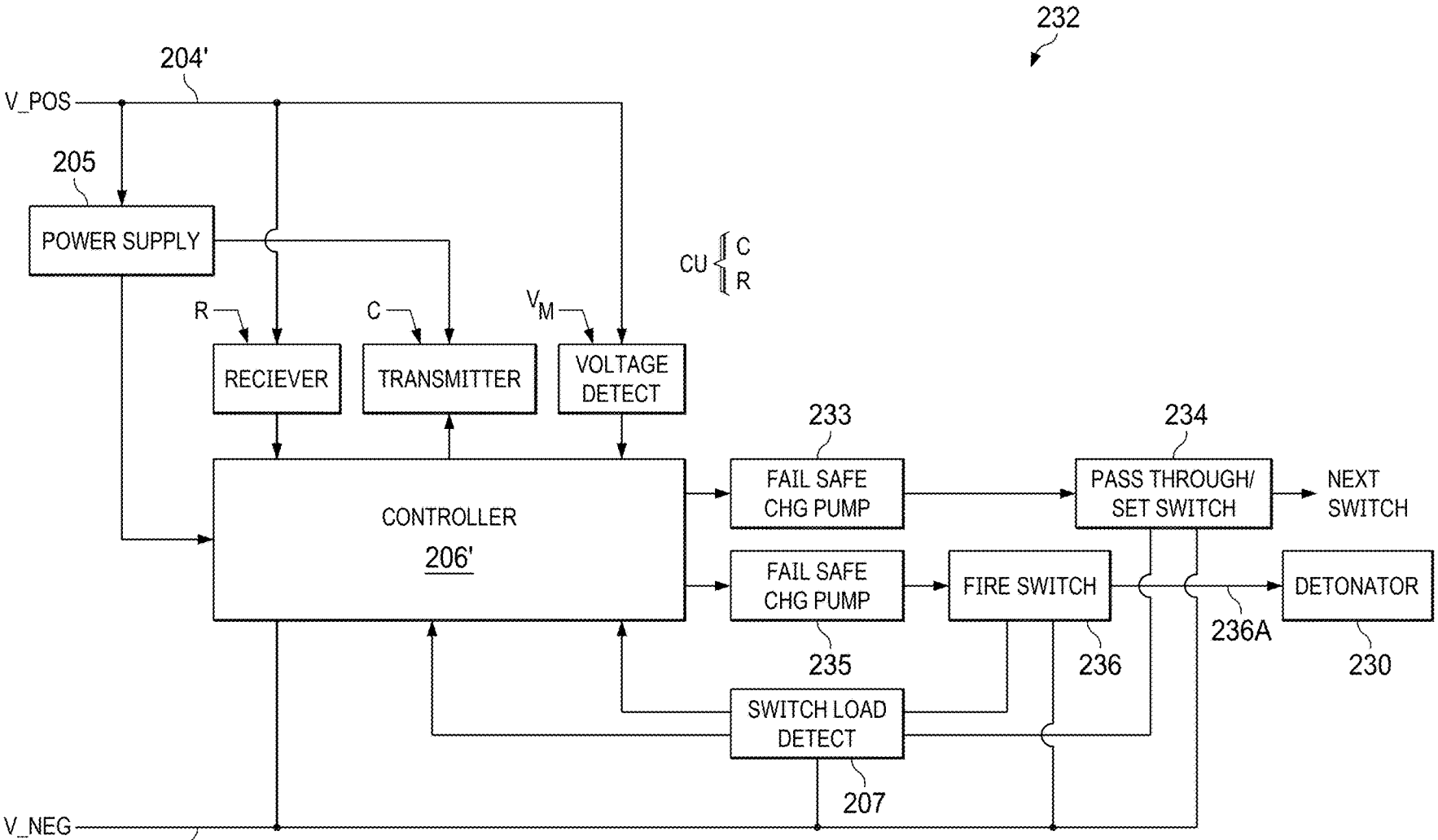

In an embodiment, switch 536 may be an addressable switch assembly 232, as depicted in FIGS. 8A and 8B. The embodiment of the switch described below is substantially similar to that described in the applicant's U.S. Pat. No. 11,333,009, the entirety of which is hereby incorporated by reference. Although switch 536 is disposed within power charge adapter 525 for use in initiating power charge 526 of setting tool 514, it is preferably interchangeable with other switches disposed in perforating guns 518. As described below in further detail, each switch disposed within perforating system 501 may have multiple possible operating modes. These operating modes may include a standard operating mode, in which the switch is configured to initiate the detonator in a perforating gun 518, or a set/fire operating mode, in which the switch is configured to initiate igniter 528, thereby igniting power charge 526 of setting tool 514.

The addressable switch assembly 232 may include thru-line switch 234 and detonator switch 236. These two switches may be implemented in hardware (e.g., with semiconductor devices that may include one or more diodes and/or transistors) or in software or both. In this embodiment, it is assumed that the two switches are implemented in software (i.e., in the processor PA). In this case, the two switches 234 and 236 in FIGS. 8A and 8B are logical blocks that describe the functionality performed by these switches and also their connections to other elements. This means that these logical blocks are physically implemented in the processor PA.

The processor PA may also include a logical voltage measuring block VM that is configured to measure a voltage present in the thru-line 204, or more specifically, the input thru-line 204-*i*. Further, the processor may include an interface, for example, a logical or physical block I/O, that can exchange various input and output commands with the controller 206 through the thru-line 204. Logical block I/O may also communicate with the voltage measuring block VM for receiving the measured voltage V and providing this value to the computing core CC of the processor for performing various calculations. Processor PA is connected to the memory 238 via a bus 239. Computing core CC is capable of storing and/or retrieving various data from the memory 238 and performing various calculations. In one embodiment, memory 238 is an erasable programmable read-only memory (EPROM), i.e., a non-volatile memory, which is a type of memory that retains its data when its power supply is switched off. This type of memory has the advantage of retaining an address and/or a mode status variable associated with the switch assembly when no power is supplied. Regarding power, it is noted that in this embodiment the switch assembly receives its power along the thru-line 204, i.e., there is no local power supply in the switch assembly or the sub.

The processor PA may further include a communication unit CU that is configured to exchange data with the controller 206. As will be discussed later, various commands could be sent by the controller 206 to a given switch assembly. The communication unit CU intercepts those commands (which are sent along the thru-line 204) and determines, in collaboration with the computing core CC, whether the commands are addressed to the specific switch assemblies. The communication unit CU is also configured to send an address (the digital address of the switch assembly, which is stored in the memory 238) of the switch assembly to the controller 206 upon a powering operation of the switch assembly. The communication unit CU may be configured to use any known communication protocol. The communication unit CU may be implemented in software, as a logical block in the processor PA, as illustrated in FIG. 8A. However, the communication unit may also be implemented as dedicated hardware or a combination of hardware and software. For example, FIG. 8B shows the communication unit CU being implemented as a receiver R and a transmitter T. FIG. 8B also shows a local controller 206'.

The processor PA may further include one or more timers. FIG. 8A shows a first timer 246A and a second timer 246B. These timers may be implemented in software, and thus the blocks labeled 246A and 246B in FIG. 8A describe logical blocks associated with these timers. These timers may be implemented in controller 206' in the embodiment illustrated in FIG. 8B. However, in one embodiment, these timers may be implemented as dedicated hardware in combination or not with appropriate software. Although FIG. 8A shows two timers, one skilled in the art would understand from this description that only one timer may be used or more than two timers. The timers are configured to count a given time interval. For example, the first timer 246A may count down from 20 s while the second timer 246B may count down from 1 s. Other values may be used. Once the given time intervals have lapsed, the timers send a message to the processor indicating this fact. As will be discussed later, these timers may be used for implementing safety procedures regarding the firing of a detonator.

FIG. 8A further shows two wires (fire wires) 236A and 236B connecting the detonator switch 236 to the detonator 230. The embodiment of FIG. 8B uses only a single wire 236A for connecting the detonator switch 236 to the detonator 230. The two wires in FIG. 8A are connected to the detonator 230, which is not part of the switch assembly 232. However, one skilled in the art would understand that the detonator may be made part of the switch assembly. The elements discussed above with regard to the switch assembly 232 are located inside of a housing 242. The housing can be made of a metal, e.g., aluminum, or a composite material. In one embodiment, the switch assembly is located inside a detonator block 210, which is configured to also host the detonator or igniter. Power charge adapter 525, as discussed above, is one embodiment of such a detonator block housing both igniter 528 and switch 536. The entire switch assembly may be distributed on a printed circuit board 244, as schematically illustrated in FIG. 8A.

The embodiment of FIG. 8B shows that two lines 204 and 204' may enter the switch assembly, where one line has a positive voltage and the other line has a negative voltage. The switch assembly may have its own power supply 205 that supplies a DC voltage (e.g., 5 V) to the controller 206'. The embodiment shown in FIG. 8B also includes a failsafe mechanism 233 for the thru-line switch 234 and a failsafe mechanism 235 for the detonator switch 236. A switch load detect unit 207 detects whether or not there is an electrical load present on the output of switches 234 and 236. The switch load detect unit 207 reports the load status to controller 206', and this information is sent to the surface controller 206 and/or used by the downhole controller 206' in its decision-making tree.

As noted above, the structure shown in FIG. 8A or 8B can be used for all the switch assemblies within perforating system 501, i.e., for the switch assemblies that are connected to a single detonator, but also for the lower switch assembly 536, which is connected to igniter 528 of power charge adapter 525 disposed adjacent to power charge 526 of setting tool 514. In many conventional systems, the setting tool required a separate and unique addressable switch for the actuation of the igniter. The switch assembly illustrated in FIGS. 8A and 8B eliminates the need for the setting tool switch, as the address and operating mode of the lowermost switch assembly 536 allows that switch assembly to apply a shooting voltage to igniter 528.

In addition, the switch assembly 232 can now be programmed remotely so that it acts in a first operating mode by default, for example, as a standard addressable switch, or in a second operating mode (e.g., as a rapid fire addressable switch), or in a third operating mode (e.g., as a set/fire addressable switch), or in a fourth mode (e.g., as a rapid fire set/fire switch). All these modes are discussed in more detail later. While this embodiment illustrates the capability of the same switch assembly 232 to be programmed to act according to four different operating modes, one skilled in the art would understand that the switch assembly may be programmed to act according to more or less operating modes. To convert the switch assembly 232 from one operating mode to another operating mode of the plural modes noted above, the existing telemetry system of the gun string can be used by the controller 206 and one or more instructions may be sent to the switch assembly to change a value of the mode status variable in the memory 238 associated with the processor PA.

In this way, the operator of the gun string can use a single switch assembly part number for any well, and if the need is to have the switch assemblies to operate in a given operating mode, just prior to deploying the gun string into the well, a given bit of information in the memory 238 of the switch assembly 232 can be changed to the desired operating mode. While in this embodiment the operating mode of the switch assembly 232 is selected prior to deploying the gun string in the well, the same operation can be performed after the gun string has been deployed into the well. In one application, all the switch assemblies 232 are modified to operate according to a same selected operating mode. This means that if the switch assemblies are shipped to the operator of the well to operate in a given operating mode, the operator can change all the switch assemblies to operate in another operating mode. However, in one embodiment, it is possible to select only a subset of the switch assemblies using their digital address, and to change all these switch assemblies from the given operating mode to the other operating mode, and leave all the other switch assemblies unmodified. The details of how to convert an addressable switch assembly from one operating mode to another operating mode, and also how to determine in which operating mode a given switch assembly operates are discussed later.

The digital convertible and addressable switch assembly 232 of FIG. 8A or 8B is programmed to communicate with a surface logging and/or perforating system (e.g., controller 206), which provides improved safety and perforating reliability of individual gun control from the surface.

The switch assembly 232 may be designed to provide an exact form replacement to the EB style switches previously in use in the industry. The electronic circuit board 244 of the switch assembly 232 may be potted within the metallic housing 242 by a thermally conductive, electrically isolation epoxy that also provides both electrical and mechanical shock survivability. The construction of the switch assembly has no moving parts, making it ruggedly built to withstand the blast of the perforating gun assembly and the downhole well pressure.

In one embodiment, each switch assembly's processor and/or memory is pre-programmed with a unique digital address, which is dynamically capable of being changed in the field. Each switch assembly may be positioned within a sub connected to a gun assembly to enable the firing of that specific gun assembly while maintaining pressure containment to enable the intrinsically safe arming, and shooting of a single specific gun assembly.

A perforating system 501 (also sometimes referred to as a "perforating string" or a "gun string") is shot starting with the setting tool 514, which sets a plug. Before the perforation operation begins, the plug seal is hydraulically tested and afterwards the bottom gun assembly in the string is shot, followed by multiple gun assemblies being shot at predetermined points along the course of the well bore. As each gun assembly is shot, the thru-line and electronics associated with the corresponding convertible and addressable switch assembly 232 is damaged/disabled by the pressure waves generated by the charges of the gun assembly. Therefore, the convertible and addressable switch assembly cannot be re-used for a second shooting. However, the mechanical housing 242 of the switch assembly 232 is configured to maintain the pressure integrity of the adjoining gun assembly and the electronic circuitry is reset to prevent voltage being applied to accidentally fire a next gun assembly.

Each switch assembly may be configured in software internal to the processor PA to provide the capability of firing a single gun assembly or, at the operator discretion, in the field, to be used as the bottom gun/setting tool switch. Also, each switch assembly has the capability of adjusting a given byte of its memory for indicating which operating mode to employ. The lower switch assembly's fire capability is selected at the final assembly of the gun string by changing the address, for example, to a pre-determined value to enable that functionality.

Figure 9A:
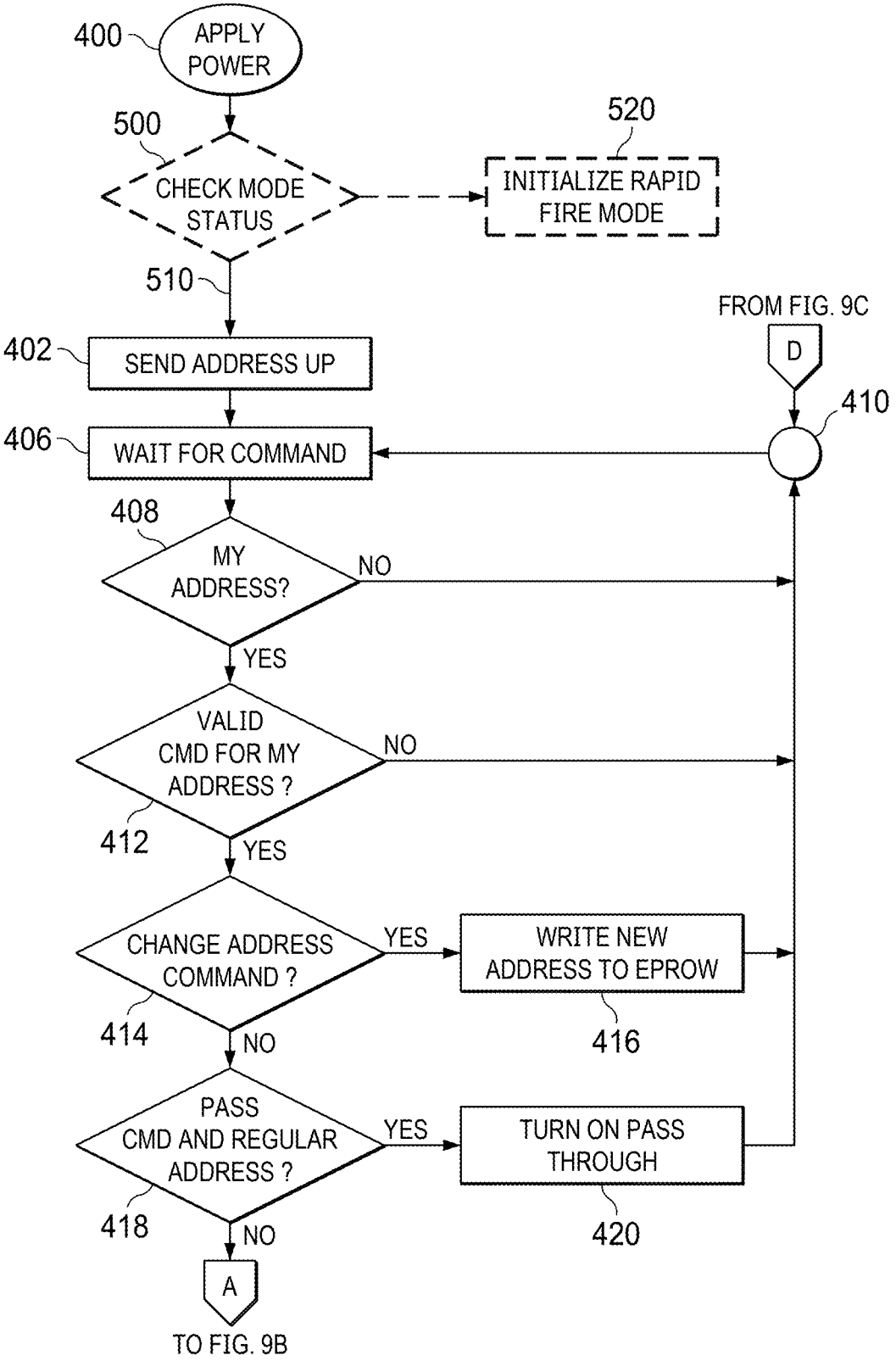
FIGS. 9A to 9C are a flow chart of a method for selecting an addressable switch assembly and actuating an associated detonator or igniter.
Figure 9B:
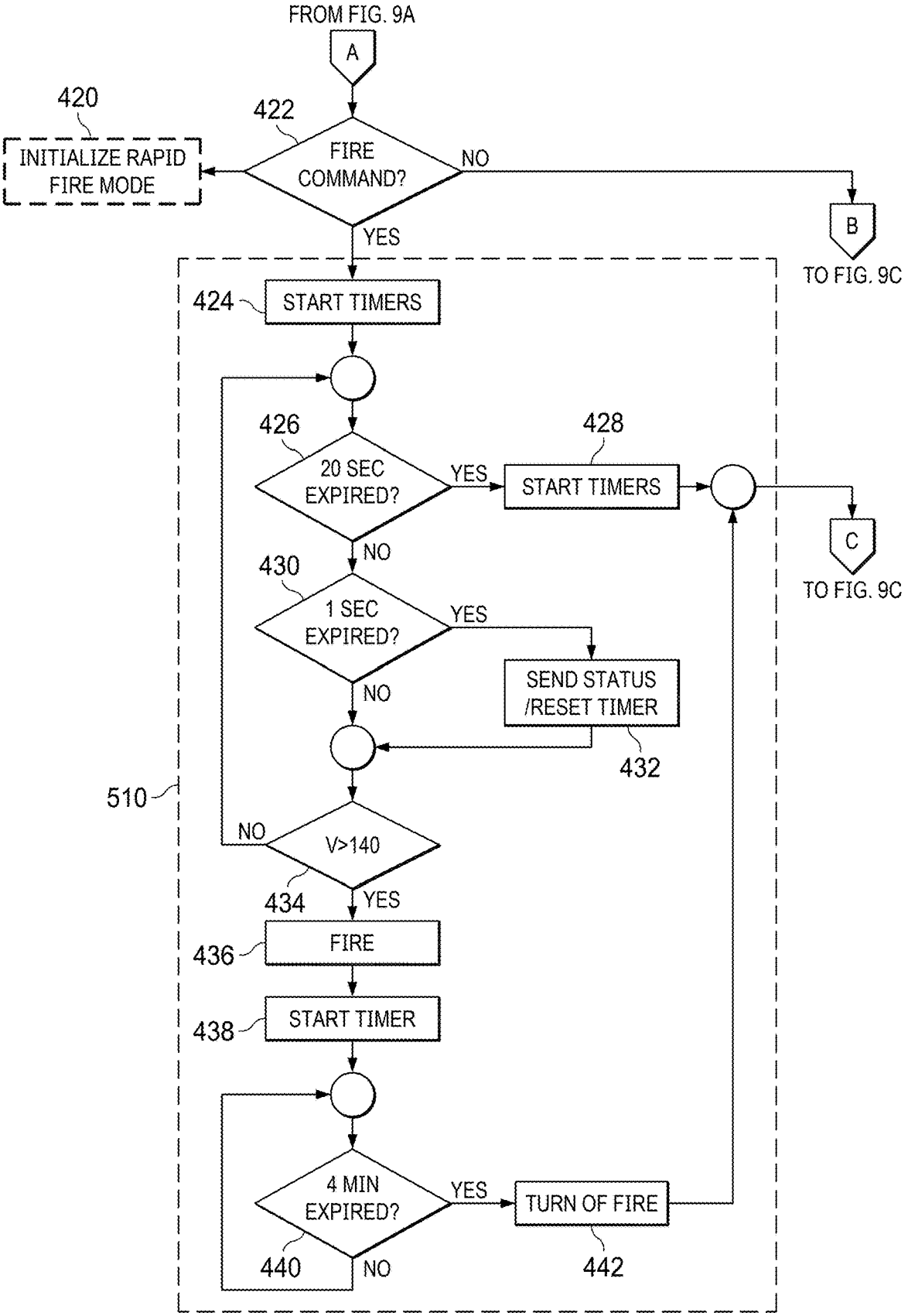
Figure 9C:
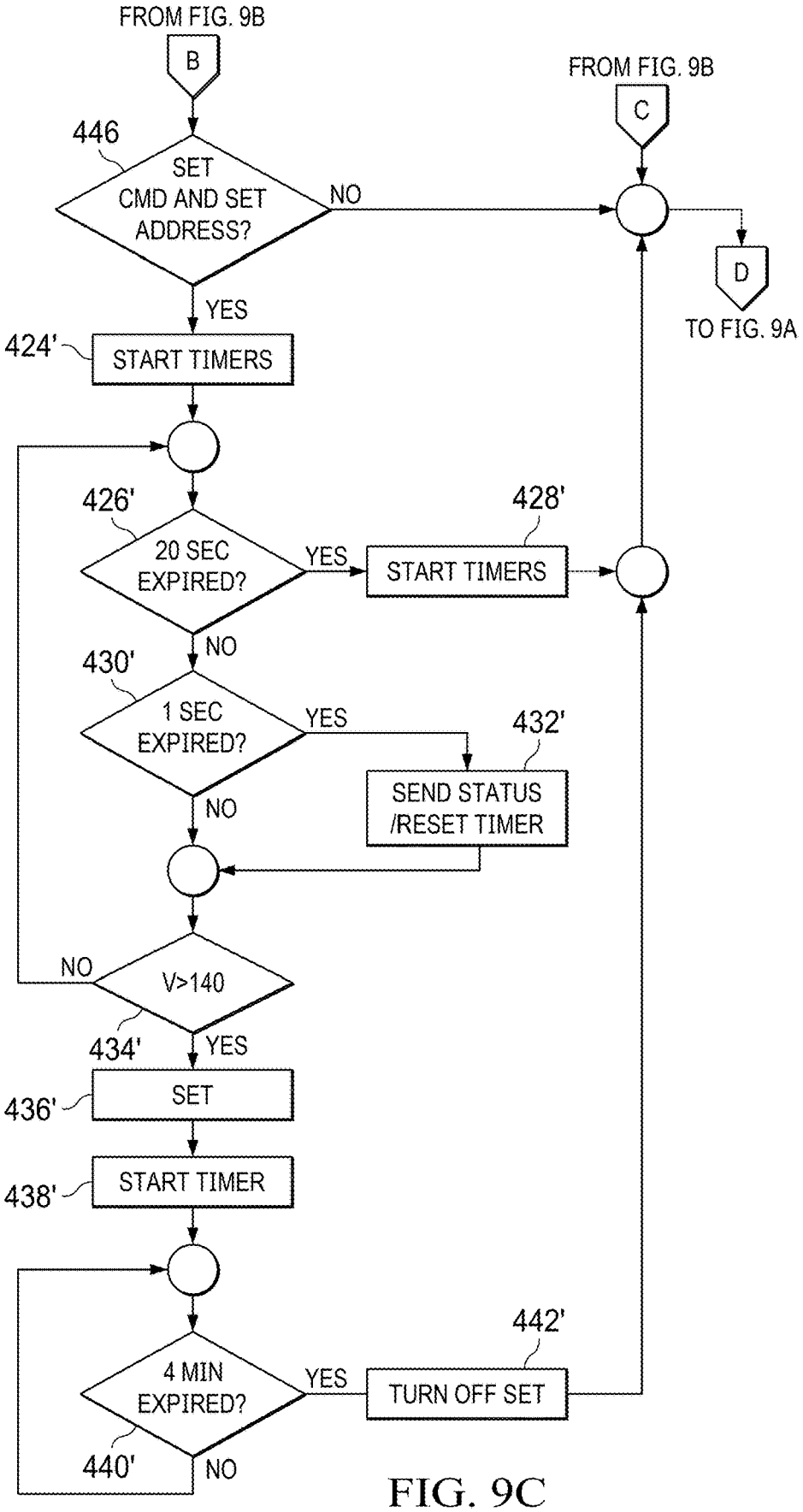

The selection of a given switch assembly and various operations and/or operating modes associated with the shooting of a gun assembly are now discussed with regard to FIGS. 9A to 9C. Suppose that the switch assemblies have been provided in the corresponding subs, and the subs have been connected to the corresponding gun assemblies so that the entire gun string is assembled. Also, suppose that all the switch assemblies have been programmed by the manufacturer to act as standard addressable switch assemblies, i.e., to operate in the standard operating mode. Either before the gun string is lowered into the well, or after the gun string has been deployed inside the well, power is applied in step 400 from the controller 206 through the wireline (that includes the thru-line) to the gun string. At this time, all the thru-line switches of the switch assemblies are open, which means that the power is received only by the upper switch assembly 232A, but not by the other switch assemblies.

Upon receiving power in step 400, the first switch assembly 232A sends in step 402 its digital address up to the controller 206. This digital address, as discussed above, can be pre-assigned by the operator of the gun string before assembling the gun string, can be pre-assigned by the manufacturer of the gun string, or can be a random address that was generated when the memory 238 was manufactured. In one embodiment, the digital address of the entire switch assembly can even be an incomplete address. After sending its digital address to the surface controller 206, the switch assembly waits in step 404 for a command from the controller 206.

Controller 206, upon receiving the digital address of the first switch assembly of the chain of switch assemblies, stores this address in an associated memory and maps the first switch assembly of the chain with this digital address. This mapping may be recorded in a table kept by the controller. The table would also include the digital addresses of all the switch assemblies in the chain, as each switch assembly is powered up.

After all the thru-line switches are closed and the controller is able to communicate with each of them, further commands may be sent from the controller. When a command from the controller 206 is sent along the thru-line 204, each switch assembly intercepts that command and verifies in step 408 whether an address carried by the command matches the address of the switch assembly. If the result of this step is NO, the process advances to step 410, which returns the process to the step 406 of waiting for a command. However, if the result of step 408 is YES, i.e., the command sent by the controller 206 is intended for the given switch assembly, the process advances to step 412, where a determination is made of whether the command is valid for the given switch assembly. For example, suppose that the command includes the correct digital address of the upper switch assembly 232A, but instructs it to fire igniter 528 of power charge adapter 525. As previously discussed, igniter 528 of power charge adapter 525 is controlled by switch assembly 536, not the upper switch assembly 232A. In this case, step 412 determines that the command, although addressed to the correct switch assembly 232A, it not valid for this switch assembly. Thus, the process is returned to step 406 for waiting for another command.

However, if the received command has the right digital address and is a valid command for the switch assembly 232A, then the process advances to step 414. In step 414, the processor of the switch assembly determines whether the command is related to (1) changing an address of the switch assembly, and/or (2) changing a value of a mode status variable at a given location in the memory 238. In one application, the given location is located in a non-volatile part of the memory 238. The mode status variable may take any number of desired values. For example, in one application, the mode status variable can take two values, 0 or 1, where 0 indicates "standard addressable switch" status and 1 indicates "rapid fire addressable switch," or the other way around. However, in another application, it is possible that more operating modes are implemented, in which case the mode status variable can take 4 or more values.

Thus, in block 414, the switch assembly 232 determines whether its digital address needs to be changed, or if its operating mode needs to be changed, or if both of these parameters need to be changed, or none of them need to be changed. If any of these parameters needs to be changed, then the process advances to step 416, during which the original digital address of the switch assembly is replaced with a new one selected by the operator of the chain, and/or the mode status variable is changed from one value to another value, i.e., the switch assembly is converted from one operating mode to another operating mode.

In other words, according to this step, the operator not only can dynamically assign new addresses to some or all of the switch assemblies of the gun string (due to the switch assembly addressable property), but also can change the operating mode (due to the convertibility property) of some or all of the switch assemblies as the field conditions of the well require. If a new address for the switch assembly and/or a new value for the mode status variable has been assigned in step 416, the new address and/or new value is written to the non-volatile part of the memory 238 and then the process returns via step 410 to the waiting step 406. Alternatively, if the original address of the switch assembly is incomplete, using the process described above, the operator is able to complete the address.

If the command from the controller 206 is not related to assigning a new digital address and/or a new value for the mode status variable, the processor PA checks in step 418 whether the command is related to a "pass" command. A pass command is designed to close the thru-line switch 234A so that power can be supplied to the next switch assembly 232B. If this is the case, then in step 420 the processor PA closes the switch 234A and the process returns to the waiting step 406.

If the command received in step 418 is not a pass command, then the process advances to step 422, where it is determined whether the command send by the controller 206 is a "fire" type command. A fire type command instructs the switch assembly to close the detonator switch for firing the corresponding detonator. As previously discussed, the switch assembly can be configured to fire the detonator in a standard mode or rapid fire mode or other modes as will be discussed later. At this step, the processor of the switch assembly checks the value of the mode status variable, and determines if the switch assembly should be initialized for standard operating mode or rapid fire operating mode. Note that although the switch assembly may be initialized for other modes, for simplicity, only these two operating modes are discussed herein.

Figure 10:
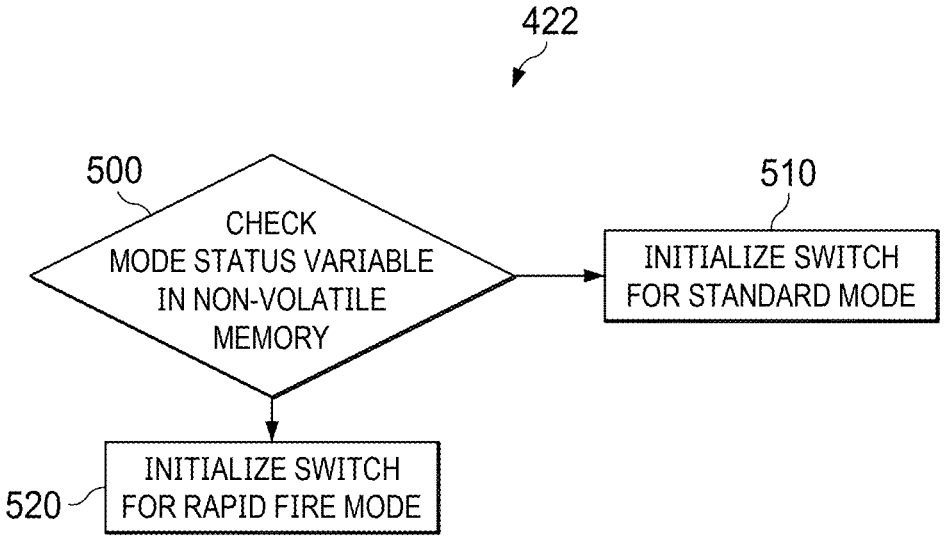
FIG. 10 illustrates in more detail a step of selecting an operational mode of a convertible and addressable switch assembly.
Figure 12:
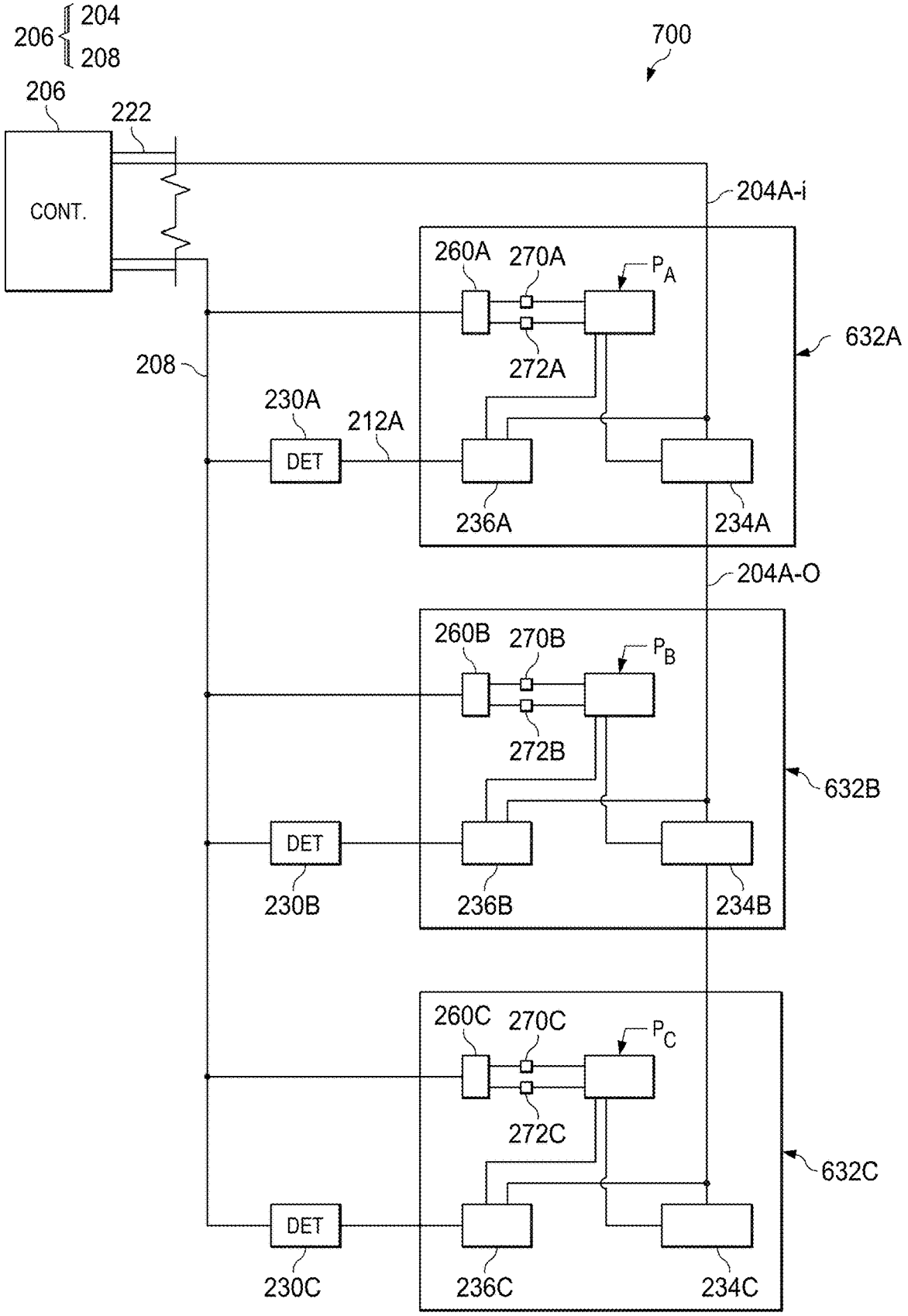
FIG. 12 illustrates a chain of convertible and addressable switch assemblies distributed in a gun string.

In this regard, FIG. 10 illustrates step 422 in more detail, and shows that upon receiving the command from the controller 206, the processor of the switch assembly 232 checks in step 500 the mode status variable stored in the non-volatile memory, and determines that the switch assembly should be initialized for the standard operating mode 510, which is detailed in steps 424 to 442, or determines that the switch assembly should be initialized for the rapid fire operating mode in step 520, which is discussed later with regard to FIG. 12. Thus, the steps 510 and 520 prepare the switch assembly according to the desired operating mode. In one application, it is possible to implement step 500 directly after applying the power in step 400, in FIG. 9A. For this reason, steps 500 and 520 are illustrated with a dash line after step 400. One skilled in the art would understand that steps 500, 510, and 520 may in fact be performed anywhere along the chain of steps shown in FIG. 9A, before step 422.

If the command in step 422 is a fire command and the value of the mode status variable corresponds to the standard operating mode, then the process advances to step 424, at which point the first timer 246A is started. Note that step 422 has already initialized the switch assembly to act in the standard fire mode or a rapid fire mode, or other modes that are discussed later. The first timer 246A may be programmed to count down a first time interval, e.g., a 20 s period. Other time periods may be used. The processor checks in step 426 whether the time period has elapsed. If the answer is yes, then the process stops in step 428 the first timer (and other timers if they have been started) and returns to the waiting step 406.

A second timer 246B may also be started in step 424. Starting this second timer is optional. If this second timer is present and started, then it counts down a second time interval, shorter than the first time interval of the first timer. In one application, the second time interval is about 1 s. When the processor determines in step 430 that the second time interval has lapsed, the processor sends in step 432 the status of the switch assembly (e.g., whether the switches are closed or open, whether a voltage has been measured, the value of the mode status variable, etc.) back to the controller 206. Further, in the same step 432, the second timer is reset to count down again the second time interval.

The purpose of these two counters is now explained. Returning to step 422, assume that a fire command has been send from the controller 206 to the switch assembly 232A. To actually fire the detonator associated with this switch assembly, it is not enough to only send the fire command (first condition) because that command may be sent in error. Thus, a second condition needs to happen in order to actuate the detonator. This second condition is the detection in step 434 of a parameter (e.g., voltage) characterizing the thru-line 204 and determining whether a value of this parameter is larger than a given threshold. For example, the threshold voltage can be 140 V. Other values may be used. Note that a voltage in the thru-line during normal operation is much less than the threshold voltage, e.g., about 30 to 40 V. Those skilled in the art would understand that other parameters than voltage may be used, for example, a given frequency.

In this regard, the controller 206, which has the ability to change the value of the mode status variable in the non-volatile part of the memory of each switch assembly, is configured to operate in a low voltage mode when interacting with the switch assemblies for setting the values of their mode status variables. This is to prevent an accidental firing of the detonator. Thus, in this mode, the controller 206 is configured to generate signals having an electrical power at a percentage of the minimum fire current needed by the detonators to be fired. In one application, the controller operates at about 10% of the minimum fire current needed to detonate the detonator, i.e., at a reduced current. Other values for this percentage may be used. This makes safe the process of changing the value of the mode status variable of each switch assembly while the gun string is live. Thus, the controller 206 verifies all the switch assemblies that they are able to communicate and they are able to detect their detonators, while using the reduced current. Also, the controller 206 operates at the reduced current to configure the switch assemblies to function in a desired operating mode, e.g., standard mode, rapid fire mode, set/fire switch mode, etc. In one application, as discussed later, the controller 206 is capable of configuring all the switch assembly to act in the standard operating mode, and to configure the most bottom switch assembly as a set/fire switch just prior to running the gun string into the well. The controller 206 includes, in one embodiment, a display that displays all this information to the operator of the well in real time and records the results of each test in its non-volatile memory for later analysis and download.

Thus, after the fire command was received in step 422 and the first timer was started in step 424, if a voltage increase above the threshold voltage is not detected (second condition for firing) in step 434, the process returns to step 426. If the first timer has counted down the first time interval, as a safety measure, because the second condition has not been fulfilled, the process stops the timers in step 428 and returns to the waiting step 406.

While the process loops from step 434 back to step 426 and so on during the first time interval, the second timer 246B counts down the second time interval, which is much shorter than the first time interval, which results in information about the status of the switch assembly being sent in step 432 to the operator of the gun string. In this way, the operator is constantly appraised about the status of the switch assemblies. Note that this bidirectional exchange of information between the controller 206 and a given switch assembly happens in the standard operating mode but not for the rapid fire operating mode. For the rapid fire operating mode, no commands or data is exchanged between the surface controller and the switch assembly, as discussed later, which makes this mode "rapid."

However, if a voltage increase above the threshold voltage is detected by the voltage measurement unit VM in step 434 while the first time interval has not lapsed, then the process advances to step 436 to fire the detonator 230A. Note that different from all the existing methods in the field, the ultimate/final decision to fire the detonator is made at the switch assembly level, i.e., by the local processor PA, and not by the surface controller 206. In other words, while the initial decision to fire a gun assembly is made by the operator of the gun string at the controller 206, the final decision to actually fire that gun assembly is made locally, at the switch assembly (in step 434). This two-step decision method ensures that the initial decision was not a mistake and also prevents firing in error the detonator.

As a further safety measure (a fail-safe measure), a third timer (or the first timer) is started in step 438 and is instructed to count down a third time interval. The third time interval may be larger than the first time interval, for example, in the order of minutes. In this specific embodiment, the third time interval is about 4 min. If the detonator was actuated in step 436, as previously discussed, the detonation of the charges in the gun assembly would likely destroy the switch assembly 232A and thus the process stops here for this specific switch assembly.

However, in the eventuality that the detonator failed to actuate, for any reason, when the processor PA determines in step 440 that the third time period has elapsed, it locally decides to turn off the fire process in step 442 and the process returns to the waiting step 406. The processor may also send a status report in step 442 to the controller 206 informing that the fire process has failed. Thus, the operator may decide to repeat the firing process or decide to skip the firing of this gun assembly. Irrespective of the decision of the operator, to fire the next gun assembly, the operator again sends a command to a next switch assembly, and repeats the procedure described in FIGS. 9A to 9C.

The processes discussed above may apply to any of the switch assemblies shown in FIGS. 8A and 8B. Once the pass command has been applied to each switch assembly, the controller 206 is capable of instructing any of the switch assemblies, irrespective of their position in the chain of switch assemblies, to fire its corresponding detonator, due to the selectivity afforded by the unique digital address of each switch assembly. This feature is reflected in step 408, which checks for a match in the digital address sent by the controller 206 and the digital address of each switch assembly.

Next, the process of firing igniter 528 of setting tool adapter 525 and not the detonator of the gun assembly associated with the lower switch assembly is discussed. If a command having the address of switch 536 is sent (see step 408 that verifies the address), and the command is valid (step 412), and the command is neither a change address command (see step 414) nor a pass through command (see step 418), and the command is also not a fire command (see step 422), then the processor PA determines in step 446 whether the command is associated with igniter 528. If the answer is no, the process returns to the waiting step 406. If the answer is yes, the process advances to step 424', which is similar to step 424 discussed above, except that step 424' is applicable to igniter 528 associated with setting tool 514.

The following steps 426' to 442' are similar to the corresponding steps 426 to 442 and thus, their description is omitted herein. The same safety features are implemented for the setting tool as for the gun assembly, i.e., the first to third timers. Note that initiating igniter 528 is possible only for switch 536 as this switch assembly is the only one that can execute a setting tool command. This is possible because switch 536 (which may also be identified as lower switch assembly 232M) checks whether the mode status variable in the received command has a first value or a second value. The first value is associated with a fire command while the second value is associated with a setting tool command. Thus, when a command from the controller 206 is received and includes the digital address of switch 536 and the mode status variable has the first value, the processor follows steps 424 to 442. However, if the command includes the digital address of switch 536 and the mode status variable has the second value, the processor follows steps 424' to 442'.

The address of switch 536 is set up by the controller 206 in step 414. As previously discussed, each switch assembly has a complete or partial address, either pre-assigned or randomly assigned during the manufacture process of the memory. In step 414, when the controller 206 determines that switch 536 (lower switch assembly 232M) is the last one in the chain of switch assemblies, the controller 206 may assign an additional address to switch 536. This additional address is directly linked to setting tool 514 and it is checked in step 446 discussed above.

Returning to the concept of dynamically addressing a switch assembly (see steps 414 and 416 in FIG. 9A), the following aspects are further discussed for clarification. According to this method, it is possible to set switch addresses in a gun string during the initial testing, after a gun string has been assembled or at any other time. The procedure of dynamic addressing may be accomplished using a test box or a control system designed for this purpose, for example, the controller 206.

In one application, upon power being applied to the chain of switch assemblies, the first switch assembly powers up, performs internal testing of its circuits, and tests for the presence of a detonator. After a short delay, it sends up this information (see step 402) to the test box with an uninitialized address. The test box will recognize this address and sends a command (see step 414) which instructs the switch assembly to reprogram its address to the one sent in the command. The test box then sends the "pass through" command in step 418. At this point, the switch assembly will "pass through" the voltage to the next switch assembly in the chain, and the process is repeated until all the switch assemblies in the chain are accounted for.

During the operation of the gun string, the surface logging and/or perforating system (i.e., controller 206) may poll the gun string. This polling process is initiated by applying power to the upper switch assembly 232A in the gun string. Upon powering up, the upper switch assembly transmits its address up the wireline and the value of the mode status variable and then automatically reverts to a low power listening mode state. The controller 206 receives and identifies the unique address of the switch assembly and its mode status variable and positions this switch assembly in the gun string. Then, the controller 206 transmits a digital code (pass through command) back down-hole to the switch assembly that instructs the switch assembly to apply power to the next switch assembly in the string below.

Power is then applied to the next switch assembly down the gun string. The process is repeated for each switch assembly or any number of gun assemblies in a gun string. When the controller 206 detects the lower switch assembly in the string, a record of the number, address and position in the gun string of all the switch assemblies is recorded.

As previously discussed, the switch assemblies have been designed with a plural purpose operation mode variable. In one application, the switch assembly can be set for (1) a standard operating mode firing with pass through, (2) or rapid fire operating mode with pass through, or (3) a set/fire operating mode for igniting the setting tool, or (4) a ballistic release tool operating mode, or (5) with any combination of these modes. A unique value may be used to determine which mode to be used. The set/fire operating mode may follow the same fire procedure to set a plug as discussed above with regard to FIGS. 9A to 9C.

After all the switch assemblies in the gun string are powered up and all the digital addresses are recorded, but the rapid fire operating mode is not detected, all the switch assemblies in the gun string are in the "wait for command," low power consumption mode. The operator may then select any switch assembly in the gun string and send a "Fire Command." Note that the operator does not have to start with the lower gun assembly. With the addressable switch assemblies discussed herein, the operator has the freedom to actuate any switch assembly, wherever positioned in the chain of the switch assemblies. The unique digital address code for a specific switch assembly in the gun string is transmitted immediately followed by a unique digital coded fire command. Once the correctly addressed switch assembly understands its address code, it checks which operating mode to initiate, and then the command initiates an internal timer (see step 424). Inside this timer loop, the switch assembly sends up the wireline a status/reset code (see step 432) at 1 second interval giving the operator a visual indication of the ready to fire state of the switch assembly. This timer loop is user programmable from 10 to 60 seconds and indicates the time remaining before the switch assembly will abort the fire command and revert back to normal operation in its previously configured state. Note that the time interval with which the one or more timers are programmed in the switch assembly may be programmed before the switch assemblies are lowered into the well, but also after they are placed inside the well (see step 414).

The switch assembly's internal voltage measurement circuit monitors the thru-line voltage. If the line voltage is increased above the threshold voltage (e.g., 140 Volts) before the first timer times out, the voltage is applied to the detonator that is hard wired to the switch assembly by closing the detonator switch. If the voltage is not increased within the time allotted by the first timer, the fire command is aborted and must be re-sent from the surface system to start another time out window. Once the voltage is above the threshold voltage and the line has been connected to the detonator, another timer (third timer, see step 438) is started. In one application, this timer is about 4 minutes and ensures that the detonator is disconnected from the line in case the detonator does not fire for any reason.

However, if a switch assembly has a value for the mode status variable that corresponds to the ballistic release tool mode, then this specific switch assembly interacts differently from all other switch assemblies as now discussed. Many operators use a Ballistic Release Tool (BRT) with the gun string, and the BRT is a tool that can use an addressable switch assembly to initiate a ballistic reaction to separate the gun string from its wireline or other tool that is used to lower the gun string into the well. The BRT is useful in the event that the gun string becomes stuck in the hole at some point below the BRT, as the operator has the option to separate the wireline from the gun string at the location of the BRT, and then be able to recover the wireline and bring it back to the surface without the gun string. The gun string may be recovered at a later time using methods capable of pulling harder than the wireline is capable of pulling. The risk of using an addressable switch assembly, which is configured to act in the standard operating mode, in a BRT mode is that it creates a relatively high probability that a user inadvertently releases the gun string when the user is intending to shoot one of the top gun assembly in the gun string.

Thus, the switch assembly discussed above can be programmed with a specific address or specific value for the mode status variable, which places the switch assembly in the BRT mode. When the switch assembly is in the BRT mode, it behaves differently from the other switch assemblies. On power-up, the switch assembly in the BRT mode does not send its address in step 402, as discussed above with regard to FIG. 9A, but rather it listens for a command to be sent specifically from the controller 206 to its address, i.e., the switch assembly configured in the BRT operating mode does not "speak unless spoken to." In the event that the operator wants to release the gun string, they can send a 'Release' command to the specific BRT switch assembly address, and that will start a release sequence, which can be identical to the fire sequence described in steps 424 to 442 or 424' to 442' discussed above with regard to FIGS. 9A to 9C, with the exception that it can only be started on the 'BRT' initiated switch assembly by sending the 'BRT Release' command. While most switches will enable their passthrough on reception of a 'Pass' command as discussed above with regard to step 418, the BRT switch assembly will monitor the line voltage and enable its passthrough at the moment the line voltage passes beyond a minimum threshold (e.g., 35V). This enables the operator to power up the line to a lower voltage (for example 30V) and communicate with the BRT switch assembly without the BRT switch assembly enabling its feedthrough and powering up the lower switch assemblies. For this mode, it is thus possible to modify step 402 to check at that time the value of the mode status variable, and if the value coincides with the value associated to the BRT operating mode, that specific switch assembly does not send up its digital address.

The previous embodiments discussed how various commands are sent from the controller 206 to the switch assemblies and how the switch assemblies sent various information (e.g., their digital addresses or their status) to the controller. Thus, a bi-directional communication was established between the controller and the switch assemblies for the standard operating mode. However, this bi-directional communication takes time and limits the possibility of quickly firing the shaped charges of the various gun assemblies of the gun string. Thus, as discussed next, there is possible to implement a different scheme for firing the gun assemblies without data exchange between the surface controller 206 and the plural switch assemblies, and this is the rapid fire operating mode.

Figure 11:
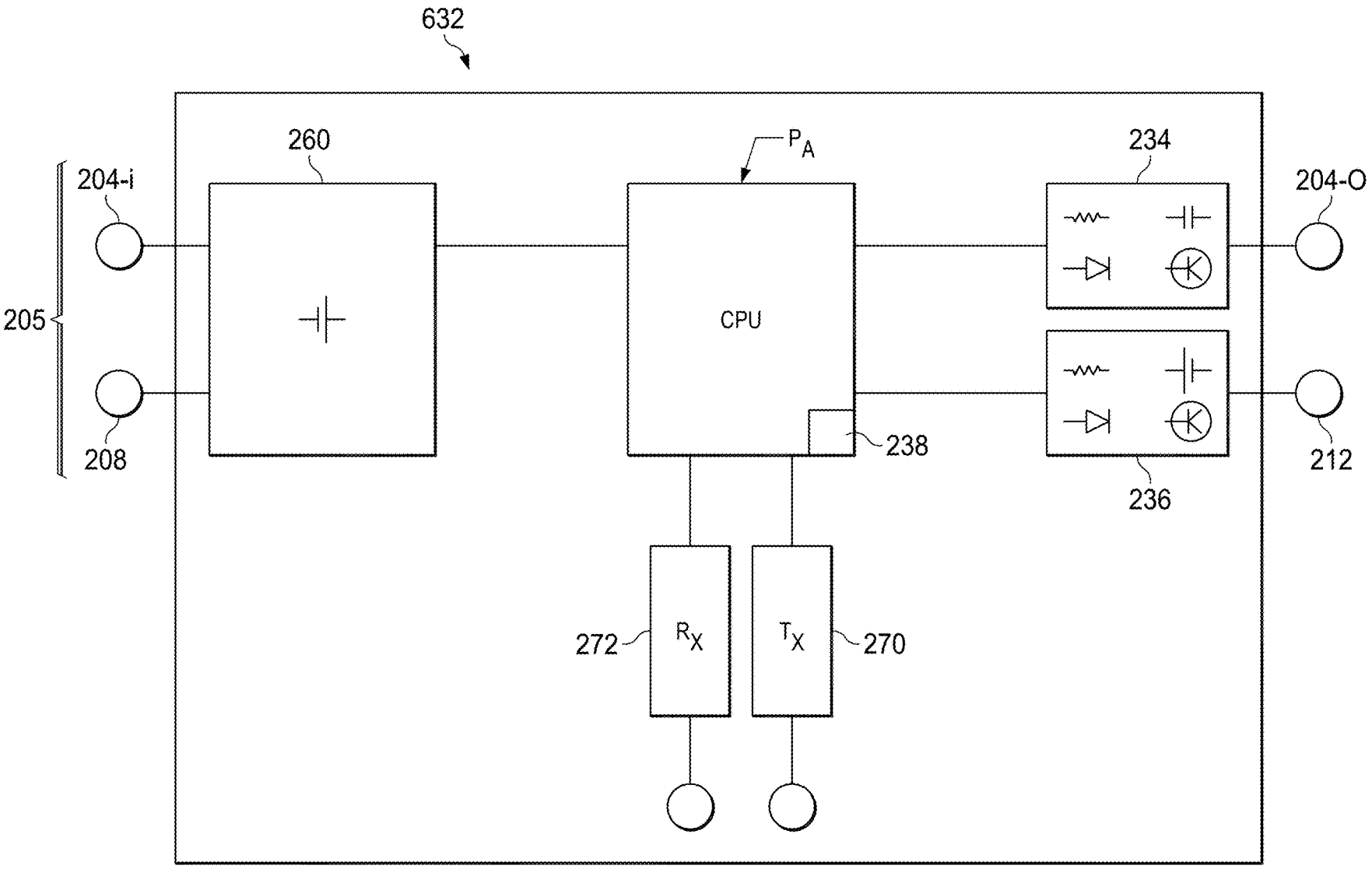
FIG. 11 illustrates a configuration of the convertible and addressable switch assembly.

According to this embodiment, as illustrated in FIG. 11, the switch assembly 232 may be modified to support the rapid fire operating mode by including a power supply 260, which is configured to provide various voltages to the switch assembly independent of the controller 206. For example, power supply 260 may include one or more transistors, diodes, resistors and capacitors. In one application, power supply 260 is connected to a telemetry system 205 that includes wires 204 and 208, and communicates with the controller 206. The telemetry system 205 is carried by the wireline 222 from the surface into the well, to each switch assembly, as illustrated in FIG. 12. The power supply 260 may also generate various DC voltages, e.g., 12 V and 5 V for internal nodes of this switch assembly 632. Note that the configuration of the switch assembly shown in FIG. 11 is described in International Patent Application PCT/US2019/036538, assigned to the assignee of this application, the entire content of which is incorporated herein by reference. However, the switch assembly in this PCT application was not configured to enter a different operating mode than the rapid fire operating mode, i.e., it was not configured to be a convertible switch assembly.

Processor PA, which is schematically illustrated in FIG. 11 but has the same structure as the processor PA in FIG. 8A, is connected to a transmit module 270 and a receive module 272, both of which are added to the switch assembly 232. The transmit module 270 and the receive module 272 may be considered to be a transceiver. With these transmission elements, the previous addressable switch assembly 232 becomes a convertible and addressable switch assembly 632, as now discussed. Note that the convertible and addressable switch assembly 632 can still perform all the functions and has all the capabilities of the addressable switch assembly 232. However, by adding the power source and the transceiver, the convertible and addressable switch assembly 632 can now also perform the rapid fire operating mode, or any of the modes previously discussed. Each of these receive and transmitter modules is implemented in hardware and may include, for example a transistor and a resistor. It is noted that a generic transmit module or receive module or switch assembly or processor is indicated in FIG. 11 by a corresponding reference number (e.g., 632) while the same element, when present in a chain of switch assemblies, is indicated by the corresponding reference number followed by a letter (e.g., 632A) that is specific to each switch assembly in the chain.

The functionalities of the convertible and addressable switch assembly 632 (simply called "switch assembly" herein) shown in FIG. 11 are now discussed with regard to FIG. 12. The switch assembly 632 can also be used in the standard operating mode, as the entire structure of the switch assembly 232 is present in the switch assembly 632. The additional structure shown in FIG. 11 about the switch assembly enables the rapid fire converting mode. This means that the switch assembly 632 can be used in either mode, by simply changing the value of its mode status variable. Therefore, if the operator of the well uses the switch assembly 632, any of the modes discussed herein can be implemented by using a same switch assembly configuration. This is not possible with existing switch assemblies.

For simplicity, FIG. 12 shows a gun string 700 that includes only three switch assemblies. However, a gun string may have any number of switch assemblies. Also for simplicity, each switch assembly is shown as a box having two switches, one micro-processor, one transmit module and one receive module. The switch assembly 632A is considered to be closest to the top of the well and the switch assembly 632C is considered to be closest to the toe of the well. This means that the switch assembly 632A may also be programmed to use the BRT operating mode while the switch assembly 632C may be programmed to use the set/fire operating mode. For the other switch assemblies 632, the BRT and the set/fire operating modes are not required, but they can be implemented if so desired by the operator of the well. The charges and other physical elements that are attached to the gun assemblies or make up the gun assemblies are omitted for simplicity herein. The figure shows only the three switch assemblies and their electrical connections to other switches, to a controller from the surface, and to their detonators.

When a switch assembly 632 is processed by the controller 206 to act in the rapid fire operating mode, each switch assembly acts as a hybrid switch assembly, i.e., it does not need to have a digital address and no commands need to be received from the surface to fire the hybrid switch assembly. If the switch assembly 632 is programmed to work in the rapid fire operating mode, the switch assembly would go through various state machines. In one implementation, each switch assembly goes through 6 state machines, as now discussed. Those skilled in the art would understand that the switch assemblies may be go through more or less state machines, depending on the value of the associated mode status variable.

After the string of switch assemblies is powered up with a selected voltage, similar to the embodiment illustrated in FIGS. 9A to 9C, and the processor of the switch assembly determines in step 500 that the value of the mode status variable corresponds to the rapid fire operating mode, the method advances to step 520 which is now detailed. In this operating mode, the selected voltage (called herein powering voltage) could be a negative voltage between 20V and 90V, which is applied between wires 204 and 208 in FIG. 7. Other voltages may be used. Once the chain of switch assemblies is powered up, each switch assembly makes a determination on whether or not it is able to fire the corresponding detonator. Then, the switch assembly communicates locally, with an adjacent switch assembly (usually located further downhole) to determine whether or not there is a switch below it, which is also able to fire. Note that in the rapid fire operating mode, the communication of a switch assembly is mainly directed to an adjacent switch assembly, and not to the controller 206. This saves time as most of the commands required by the standard communication protocol between a switch assembly and the surface controller 206 are eliminated. For this reason, this operating mode is a rapid fire mode.

As each switch assembly makes this determination, it will send a pair of voltage pulses to the surface controller 206. The surface controller 206 can interpret these pulses to determine how many switch assemblies are online, knowing that the bottom switch assembly 632C will fire when the line voltage is increased above a firing voltage. In this implementation, the firing voltage is larger than 140V. Then, the surface controller increases the line voltage to be larger than the firing voltage, and the bottom switch assembly, upon detection of this increase in voltage, and within a certain time window, fires the detonator associated with it.

After a switch assembly is fired, the power to the chain of switch assemblies is interrupted and then reapplied to the entire chain, so that the configuration process described in previous steps is repeated after each firing, to determine again which is the current bottom switch assembly. If a wiring issue or electronics failure downhole prevents a switch assembly from being able to fire, the switch assembly above it will automatically become the last switch assembly in the string, with no interference from the controller 206. This means that this process is independent of any instructions from the surface controller 206, i.e., requires no commands from the surface controller, which expedites the firing process and makes the rapid fire operating mode to be rapid indeed. However, also note that the switch assembly 632 is capable to bidirectionally exchange information with the controller 206, if the switch assembly is reprogrammed to be in the standard operating mode or other operating modes.

The six states through which each switch assembly goes are now discussed. A first state into which a switch assembly enters is the POWER-UP state. An inventory process associated with the powering-up state of the chain of switch assemblies happens at a rate of about 5 switches/second, with a slight delay on the first switch assembly while waiting for the wireline voltage to stabilize on power-up. The switch assembly's firmware implements this state machine as described below. On each power-up, an active switch assembly that has a detonator present will take approximately 200 ms to run through this state machine. The switch assembly will first check if it has been previously fired (i.e., is there an inert flag set). If this flag is set, the switch assembly will go to sleep. Otherwise, the switch assembly will start scanning the head voltage (i.e., the voltage between lines 204 and 208 in FIG. 11) by reading an analog-to-digital converter's input VIN, and not take any further action unless the following two conditions are met:

(1) The line voltage is stable (e.g., the line voltage has not changed by more than 5V) at a value less than 90V for the last T1 seconds (e.g., T1=16 ms); and (2) The switch assembly has been powered up for at least T2 seconds (e.g., T2=20 ms).

By requiring that these two conditions are met, the switch assembly cannot get into a firing state, as a result of the firing voltage being immediately applied, either intentionally or due to the line 'browning out' after firing a previous switch assembly. The head voltage reading that is described above will be referenced later to determine if the feedthrough line is shorted. Once the required conditions have been met, the switch assembly will check for the presence of a detonator. Note that all future timings of the switch assembly is based on the time at which the switch assembly exits this state (i.e., a pulse generated by the switch 200 ms after the power-up action is actually referenced as being 180 ms after leaving this state).

Each switch assembly in the string will end up in one of 3 possible states after power-up:

It will determine that it cannot fire, due to not having a detonator or having previously been set as 'inert,' and will go to sleep; or It will determine that it is able to fire and that there is another detonator-equipped switch assembly below it, in which case it will enable power to the lower switch assembly and then go to sleep; or It will determine that it is able to fire and that there are no detonator-equipped switch assemblies below it, in which case it will dump-fire on the detonator if a line voltage is sensed to be larger than the firing voltage (e.g., 140V) within a given time window (for example, a 45-second window).

Note that these states are configured to operate each switch assembly independent of the controller 206, i.e., no instructions from the controller 206 are required.

A second state of the switch assembly is the DETONATOR CHECK state. Once the switch assembly's line voltage has stabilized, it will check whether or not it senses a detonator. The presence of a detonator essentially means that there is a 50-ohm resistor connected between the wireline armor line 208 (see FIG. 6) and the line 212A (see FIG. 6) connecting the detonator switch 236A to the detonator 230A. This determination is made by the processor PA by sensing an appropriate voltage for the detonator. If the voltage sensed on the detonator line is larger than 20V, the processor PA of the switch assembly 232A determines that a detonator 230A is present. If no detonator is detected, the micro-controller instructs the switch assembly to go to sleep and would not attempt to communicate with the surface controller or any other switch assemblies. If a detonator is detected by the micro-controller, the micro-controller of the switch assembly will place a short (~24 μs) pulse on the line (204A-i) to alert the next switch assembly (above) that there is a switch assembly below with a detonator. The switch assembly will then do nothing for 75 ms, following which it will check its feedthrough connection 204A-o.

A third state of the switch assembly is the FEED-THROUGH or thru-line check state. The feedthrough check will make a determination of whether or not the feedthrough line 204A-o is shorted. If the feedthrough line is shorted, there will be a voltage that is close to VIN present on line 204A-o. A voltage on this line is measured and if it is within 5V of the voltage VIN, the micro-controller of the switch assembly determines that the feedthrough line is shorted. If the feedthrough line is shorted, the micro-controller of the switch assembly decides that it must be the final switch assembly in the string and so it goes to the PRE-FIRE state. If the feedthrough line is not shorted, the micro-controller of the switch assembly will enable its bypass line (i.e., close the thru-line switch 234A) and prepare to listen for a 24 S pulse indicating that a switch assembly below has a detonator. The terms "below" and "above" are used herein to mean "downstream" and "upstream" relative to a well.

A fourth state of the switch assembly is the LISTEN state for a lower switch assembly. As noted above, a switch assembly will not do anything after power is applied, until it has been powered on for at least 20 ms and its head voltage is stable. The 'Listen' state is entered directly after the feedthrough line has been enabled, and the first thing that the micro-controller will do during the 'Listen' state is to wait for 15 ms and then enable an interrupt to be triggered if a pulse from a lower switch assembly is detected. The micro-controller will then wait another 15 ms, turn off the bypass (i.e., switch 234A) to a lower switch assembly, and then check whether or not an interrupt was generated inside the listening window. If an interrupt was not generated, the switch assembly determines that there are no detonator-equipped switch assemblies below it and so it will go to the PRE-FIRE state. If an interrupt was generated, this will be interpreted as a lower switch assembly having a detonator is present and the micro-controller will go to the INLINE state.

A fifth state of the switch assembly is the INLINE state. If a switch assembly is in this state, it has determined that it has a detonator and that there is a switch assembly below it that also has a detonator. The micro-controller will inform the surface controller that it is an inline switch assembly by sending two long pulses P1 and P2, at times T3 and T4 (e.g., T3=180 ms and T4=200 ms after power-up). Immediately after this, the micro-controller will enable the bypass line (thru-switch 234A) for the next switch assembly to start its inventory process, and then go to sleep to minimize current consumption.

A sixth state of the switch assembly is the PRE-FIRE state. If a switch assembly reaches this state, it has determined that it has a detonator, but there are no detonator-equipped switch assemblies below it. The micro-controller will inform the surface controller, through the transmit module 270, that it is a terminating switch assembly. The micro-controller will send two long pulses P3 and P4 at times T5 and T6 (for example, T5=190 ms and T6=200 ms), and then prepare to dump fire on the detonator when the line voltage is detected to be above the firing voltage (e.g., 140V). Immediately after sending these two pulses, the switch assembly will start a timer for measuring a time window (e.g., 45-second timer) and then again verify that its head voltage is below 90V and stable for at least 20 ms. Once this has been confirmed, it will start reading its head voltage to determine if a voltage larger than the firing voltage (e.g., 140V) is present. If the voltage larger than the firing voltage is detected, the micro-controller will mark itself as inert for any future power-ups, and then enable the fire line 212A. If the 45-second timer expires before the firing voltage is sensed, the switch assembly will go to sleep and a power cycle will be required to reconfigure the string of switch assemblies.

A further state, which is optional, is the SETTING TOOL CHECK state. Alternatively, one of the previous states may be modified to include the functionality discussed herein. Once the switch assembly's line voltage has stabilized, it will check whether or not it senses a setting tool. In one application, the switch assembly would also check for the presence of a detonator not related to the setting tool. This determination is made by the processor PA by sensing an appropriate voltage for the setting tool. If the processor PA of the switch assembly 632C determines that a setting tool 514 is present, the switch assembly sends two pulses to the surface controller to inform about this determination. Further, the switch assembly 632C will place a short (~24 μs) pulse on the line (204C-i) to alert the next switch assembly (above) that there is a switch assembly below with a setting tool and/or a detonator. The two pulses may be separated by 15 ms as previously discussed. If no setting tool is detected and no detonator is detected, the micro-controller instructs the switch assembly to go to sleep and would not attempt to communicate with the surface controller or any other switch assemblies. If no setting tool is detected but only a detonator is detected, the micro-controller of the switch assembly will place a short (~24 μs) pulse on the line (204A-i) to alert the next switch assembly (above) that there is a switch assembly below with a detonator. The switch assembly will then do nothing for 75 ms, following which it will check its feed-through connection 204A-o.

One skilled in the art would understand that the times and voltages used to describe the 6 (7) states above are exemplary and other values may be used. Also, one skilled in the art would understand the simplicity of the communication scheme used by the micro-controllers for communicating with the surface controller or with other micro-controllers from the chain. In this respect, the examples discussed above use simply pulses with different time separations for communication. Thus, no digital address of the micro-controller is necessary for performing this type of communication.

Figure 13:
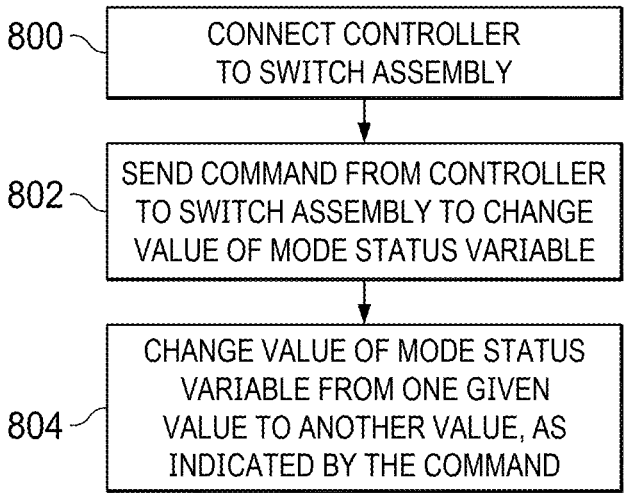
FIG. 13 is a flow chart of a method for configuring an operation mode of one or more convertible and addressable switch assemblies.

A method for converting the switch assembly 632 from one operating mode to another operating mode is now discussed with regard to FIG. 13. The method starts in step 800, when the operator connects the surface controller 206 to a part or the entire gun string, and sends in step 802 a command directed to the switch assembly 632 that needs to be converted. Note that all the switch assemblies 632 in the gun string 200 or 700 share the structure illustrated in FIG. 11, i.e., each switch assembly is configured to directly communicate with the surface controller or directly communicate with additional switch assemblies. The command includes information for changing a value of a mode status variable stored by each switch assembly in its memory 238. For example, if the default value of the mode status variable is zero, which corresponds to the standard operating mode, the command sent by the surface controller 206 includes instructions so that the switch assembly 632 changes in step 804 that variable from zero to one, where one is associated with the rapid fire operating mode. If more values are need for the mode status variable, for example, to also implement the set/fire operating mode, or the rapid fire set/fire operating mode, etc., then more than one digit may be used, i.e., 00 for the standard operating mode, 11 for the rapid fire operating mode, 01 for the set/fire operating mode, 10 for the rapid fire set/fire operating mode, etc. One skilled in the art would understand that any number of values may be implemented for the mode status variable, either using the digits 0 and 1, or in any other know way.

In step 806, the processor of the switch assembly erases the previous value of the mode status variable from the non-volatile memory and stores the new value, received from the surface controller 206. In one embodiment, the steps of sending, changing, and storing are repeated for each switch assembly in the gun string. However, in another embodiment, the steps of sending, changing, and storing are taking place only for the first switch assembly of the gun string.

The operation of setting up the value of each mode status variable by the operator of the well may be performed at the surface, when all the switch assemblies are on the ground, or after the entire gun string has been assembled and lowered into the well. In other words, the telemetry used for controlling the switch assemblies illustrated in FIG. 11 allow to convert the switch assemblies from one operation mode to another operation mode no matter the location of the switch assemblies. Note that this operation may be performed when the controller is connected to a single switch assembly, to some of the switch assemblies, or to all the switch assemblies of the gun string 700. In one application, when all the switch assemblies 632 are connected to the controller 206, it is possible to change one, a sub-set or all of the switch assemblies of the gun string, from one value to another value. In still another embodiment, it is possible to change a switch assembly from a first value to a second value, which is different from the first value, to change another switch assembly in the gun string from the first value to a third value, which is different from the first and second values, and so on. In other words, the controller can selectively change the value of the mode status variable of one or more switch assemblies to various desired values, either sequentially, or during a same operation. Any one or combination of the step and processes discussed with regard to FIG. 13 may take place at the manufacturing plant of the switch assembly, in which case the surface controller 206 is a computer system that belongs to the operator of the plant, and the telemetry system 205 includes any wiring that connects the controller to the switch assembly. The steps associated with the method illustrated in FIG. 13 may be performed on each switch assembly while only that switch assembly is connected to the controller, or when all the switch assemblies or some of the switch assemblies are together connected to the controller. If the switch assembly 632 is directly connected to the controller in the manufacturing plant, the telemetry system 205 refers to the wiring used to connect the controller to the switch assembly, the interface I/O shown in FIG. 8A may be used as the port that communicates with the controller, and the processor PA is performing, together or not with the controller, the various steps discussed in the method illustrated in FIG. 13. In other words, all the steps discussed with regard to this method can be performed by the manufacturer of the switch assembly, in a plant, hundreds of kilometers from the well, or by the operator of the well, while the switch assemblies are on the ground, next to the well, or already deployed in the well. This means that in one application, existing addressable switch assemblies may be modified in firmware to perform the steps discussed herein and to convert from one operating mode to another.

In one application, the steps of sending, changing, and storing discussed above with regard to FIG. 13 are taking place only for one switch assembly of the gun string and this switch assembly is the first in the chain of the switch assemblies. In this application or another application, each of the first and second operating modes is one of a standard operating mode, rapid fire operating mode, set/fire operating mode, rapid fire set/fire operating mode, and ballistic release tool operating mode. Other modes may also be defined by the operator according to the needs of each well.

The standard operating mode uses bidirectional communication of data between the surface controller and the switch assembly. The rapid fire operating mode uses no data communication (only one or more currents or voltages having different values are transmitted along the telemetry system; data communication is understood herein to include a command that includes a digital address that identifies a switch assembly and additional information that instructs the specific switch assembly associated with the digital address to perform a specific function) between the surface controller and the switch assembly for firing the switch assembly, so that the rapid fire operating mode takes less time than the standard operating mode. The set/fire mode is used when the switch assembly is connected between a gun assembly and a setting tool, and the ballistic release tool mode is used on a first switch assembly in the gun string to release the gun string inside the well.

After the switch assemblies of the gun string have been configured (converted) to operate in the desired operating mode, the gun string is now ready to be operated. Note that by using the same structure for all the switch assemblies, no matter of the operating mode, and having the capability to set each switch assembly to a desired operating mode, which can differ from the original purpose of the switch assembly, there is no need for the operator to forecast what type of switch assembly to use for a given well, and avoids the need of having to use different switch assemblies if the conditions at the well have been changed, which is not only time consuming, but also expensive and prone to mistakes.

Having the gun string assembled inside the well, the operator now is ready to fire the shaped charges of the plural gun assemblies of the gun string 700. In the embodiment illustrated in FIG. 14, the operator starts in step 900 by powering up the gun string, i.e., sending a small current (much smaller than the firing current) from the controller 206 to the switch assemblies 632. The local processor PA of each switch assembly can, at this early point in the process, check in step 902 the value of the mode status variable. If the value is associated with the standard operating mode, then the method continues to step 402 in FIG. 9A and follows the remainder of the steps shown there and discussed above.

However, if the value is determined in step 902 to be associated with the rapid fire operating mode discussed above with regard to FIG. 12, then the method proceeds in step 906 with the rapid fire operating mode and activates the switch assemblies by using, in this embodiment, only a change in the voltage applied to the gun string, and no commands specifically addressed to each switch assembly. In other words, for the rapid fire operating mode, the digital address of the switch assembly is not used for instructing the switch assembly to fire the detonator. Those skilled in the art would understand that the switch assembly may be activated in other ways as long as no commands are sent from the controller 206.

Figure 14:
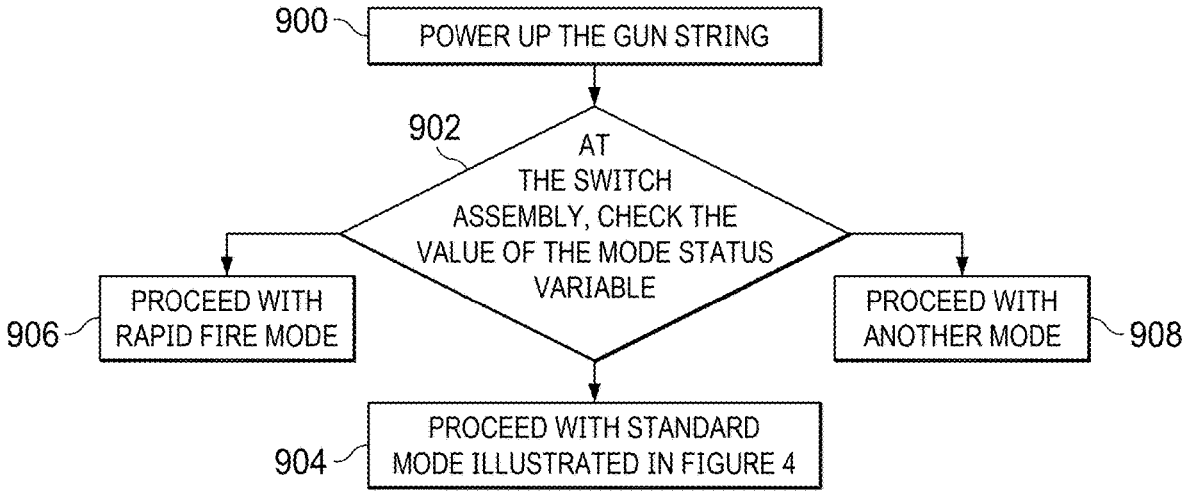
FIG. 14 is a flow chart of a method for operating the one or more convertible and addressable switch assemblies.

It is also possible that in step 902 is determined that the value of the mode status variable is associated with the BRT operating mode or the set/fire operating mode, in which case, in step 908, the method proceeds with that mode. Both the BRT and the set/fire operating modes have been described above. In this way, the method illustrated in FIG. 14 is capable to select, based on the value of the mode status variable, which operating mode to implement for the switch assemblies of the gun string 700.

In one application, the plural operating modes includes a standard operating mode and rapid fire operating mode, where the rapid fire operating mode fires the switch assembly in less time than the standard mode. In another application, the plural operating modes include two or more of a standard operating mode, a rapid fire operating mode, a set/fire operating mode, and a ballistic release tool operating mode. In this application, the standard operating mode uses bidirectional communication of data between the surface controller and the switch assembly, the rapid fire operating mode uses no data communication between the surface controller and the switch assembly for firing the switch assembly, so that the rapid fire operating mode takes less time than the standard operating mode, the set/fire operating mode is used when the switch assembly is connected between a gun assembly and a setting tool, and the ballistic release tool operating mode is used on a first switch assembly in the gun string to release the gun string inside the well. In one application, the steps of checking and initiating take place while the switch assembly is in the well. It is also possible that the steps of checking and initiating are taking place only for a single switch assembly of the gun string and the switch assembly is the first in a chain of the switch assemblies.

It is understood that variations may be made in the foregoing without departing from the scope of the present disclosure. In several exemplary embodiments, the elements and teachings of the various illustrative exemplary embodiments may be combined in whole or in part in some or all of the illustrative exemplary embodiments. In addition, one or more of the elements and teachings of the various illustrative exemplary embodiments may be omitted, at least in part, and/or combined, at least in part, with one or more of the other elements and teachings of the various illustrative embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes, and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

The invention claimed is:

1. A power charge adapter comprising:
- a first substantially cylindrical housing comprising:
  - a first end;
  - a second end comprising a throughbore; and
  - an internal cavity;
- a cap coupled to the first end of the first housing and comprising a recessed region;
- an adapter comprising a substantially cylindrical body having a first end configured to engage an outer surface of the second end of the first housing and a second end configured to engage an external power charge;
- a switch disposed within the cavity of the first housing;
- an igniter disposed within the throughbore of the second end of the first housing;
- a zero-tension connector disposed within the recessed region of the cap and comprising:
  - a second substantially cylindrical housing comprising:
    - a first end;
    - a second end comprising a throughbore; and
    - an internal cavity;
  - a sliding contact disposed within the cavity of the second housing, wherein the sliding contact comprises a body with a first end opposite a second end, and wherein a portion of the first end of the sliding contact is exposed at the first end of the second housing;
  - a first spring provided within the cavity of the second housing and configured to bias the sliding contact against the first end of the second housing; and
  - an electrical contact disposed at least partially within the throughbore of the second end of the second housing and comprising:
    - a first end connected to the second end of the sliding contact; and
    - a second end connected to the switch.

2. The power charge adapter of claim 1, wherein the switch is addressable.

3. The power charge adapter of claim 1, wherein the switch comprises:
- an interface (I/O) configured to connect to a surface controller along a telemetry system; and
- a processor connected to the interface (I/O) and configured to:
  - receive a command from the surface controller, along the telemetry system, to change a first value of a mode status variable to a desired second value, wherein the first value is associated with a first operating mode of the switch and the second value is associated with a second operating mode, which is different from the first operating mode;

change the first value to the second value; and store in a non-volatile memory the second value of the mode status variable.

4. The power charge adapter of claim 3, wherein each of the first and second operating modes is one of a standard operating mode and a set/fire operating mode.

5. A downhole tool comprising:

a tandem sub comprising a first threaded surface and an electrical contact;

a firing head comprising a throughbore and second threaded surface configured to engage the first threaded surface;

a power charge adapter disposed within the throughbore of the firing head and comprising:

a first substantially cylindrical housing comprising:

a first end;

a second end comprising a throughbore; and an internal cavity;

a cap coupled to the first end of the first housing and comprising a recessed region;

an adapter comprising a substantially cylindrical body configured to engage an outer surface of the second end of the first housing;

a switch disposed within the cavity of the first housing;

an igniter disposed within the throughbore of the second end of the first housing;

a zero-tension connector disposed within the recessed region of the cap and comprising:

a second substantially cylindrical housing comprising:

a first end;

a second end comprising a throughbore; and an internal cavity;

a sliding contact disposed within the cavity of the second housing, wherein the sliding contact comprises a body with a first end opposite a second end, and wherein a portion of the first end of the sliding contact is connected to the electrical contact of the tandem sub;

a first spring provided within the cavity of the second housing and configured to bias the sliding contact against the first end of the second housing; and an electrical contact disposed at least partially within the throughbore of the second end of the second housing and comprising:

a first end connected to the second end of the sliding contact; and a second end connected to the switch; and a second spring compressed by the tandem sub and configured to bias the zero-tension connector towards the recessed region of the cap of the power charge adapter.

6. The downhole tool of claim 5, wherein the switch is addressable.

7. The downhole tool of claim 5, wherein the switch comprises:

an interface (I/O) configured to connect to a surface controller along a telemetry system; and a processor connected to the interface (I/O) and configured to:

receive a command from the surface controller, along the telemetry system, to change a first value of a mode status variable to a desired second value, wherein the first value is associated with a first operating mode of the switch and the second value is associated with a second operating mode, which is different from the first operating mode;

change the first value to the second value; and store in a non-volatile memory the second value of the mode status variable.

8. The downhole tool of claim 7, wherein each of the first and second operating modes is one of a standard operating mode and a set/fire operating mode.

9. A downhole system comprising:

a tandem sub comprising a first threaded surface and an electrical contact;

a firing head comprising a throughbore and second threaded surface configured to engage the first threaded surface;

a power charge adapter disposed within the throughbore of the firing head and comprising:

a first substantially cylindrical housing comprising:

a first end;

a second end comprising a throughbore; and an internal cavity;

a cap coupled to the first end of the first housing and comprising a recessed region;

an adapter comprising a substantially cylindrical body configured to engage an outer surface of the second end of the first housing;

a switch disposed within the cavity of the first housing;

an igniter disposed within the throughbore of the second end of the first housing;

a zero-tension connector disposed within the recessed region of the cap and comprising:

a second substantially cylindrical housing comprising:

a first end;

a second end comprising a throughbore; and an internal cavity;

a sliding contact disposed within the cavity of the second housing, wherein the sliding contact comprises a body with a first end opposite a second end, and wherein a portion of the first end of the sliding contact is connected to the electrical contact of the tandem sub;

a first spring provided within the cavity of the second housing and configured to bias the sliding contact against the first end of the second housing; and an electrical contact disposed at least partially within the throughbore of the second end of the second housing and comprising:

a first end connected to second end of the sliding contact; and a second end connected to the switch;

a second spring compressed by the tandem sub and configured to bias the zero-tension connector towards the recessed region of the cap of the power charge adapter; and a setting tool configured to engage the firing head and comprising a power charge, wherein the body of the adapter is configured to engage an outer surface of the power charge, such that the igniter is disposed in proximity to the power charge.

10. The downhole system of claim 9, wherein the switch is addressable.

11. The downhole system of claim 9, wherein the switch comprises:

an interface (I/O) configured to connect to a surface controller along a telemetry system; and a processor connected to the interface (I/O) and configured to:

receive a command from the surface controller, along the telemetry system, to change a first value of a mode status variable to a desired second value, wherein the first value is associated with a first operating mode of the switch and the second value is associated with a second operating mode, which is different from the first operating mode;

change the first value to the second value; and store in a non-volatile memory the second value of the mode status variable.

12. The downhole tool of claim 11, wherein each of the first and second operating modes is one of a standard operating mode and a set/fire operating mode.

13. A method of setting a downhole plug comprising:

connecting a downhole end of a tandem sub to an uphole end of a firing head;

connecting a downhole end of the firing head to an uphole end of a setting tool;

and sending a signal configured to activate a switch, wherein:

the tandem sub comprises an electrical contact;

the firing head comprises a throughbore;

a power charge adapter is disposed within the throughbore of the firing head and comprises:

a first substantially cylindrical housing comprising:

a first end;

a second end comprising a throughbore; and an internal cavity;

a cap coupled to the first end of the first housing and comprising a recessed region;

an adapter comprising a substantially cylindrical body configured to engage an outer surface of the second end of the first housing;

the switch, which is disposed within the cavity of the first housing;

an igniter disposed within the throughbore of the second end of the first housing;

a zero-tension connector disposed within the recessed region of the cap and comprising:

a second substantially cylindrical housing comprising:

a first end;

a second end comprising a throughbore; and an internal cavity;

a sliding contact disposed within the cavity of the second housing, wherein the sliding contact comprises a body with a first end opposite a second end, and wherein a portion of the first end of the sliding contact is connected to the electrical contact of the tandem sub;

a first spring provided within the cavity of the second housing and configured to bias the sliding contact against the first end of the second housing; and an electrical contact disposed at least partially within the throughbore of the second end of the second housing and comprising:

a first end connected to the second end of the sliding contact; and a second end connected to the switch;

a second spring compressed by the tandem sub and configured to bias the zero-tension connector towards the recessed region of the cap of the power charge adapter; and a setting tool configured to engage the firing head and comprising a power charge, wherein the body of the adapter is configured to engage an outer surface of the power charge, such that the igniter is disposed in proximity to the power charge and the step of sending a signal configured to activate a switch results in ignition of the power charge.

14. The method of claim 13, wherein the switch is addressable.

15. The method of claim 13, further comprising:

sending a command from a surface controller to an interface within the switch to change a first value of a mode status variable to a desired second value, wherein the first value is associated with a first operating mode of the switch and the second value is associated with a second operating mode, which is different from the first operating mode;

changing the first value to the second value; and storing in a non-volatile memory in the switch the second value of the mode status variable.

16. The method of claim 15, wherein the steps of changing and storing take place while the switch assembly is located at the surface.

17. The method of claim 15, wherein each of the first and second operating modes is one of a standard operating mode and a set/fire operating mode.

* * * * *